US006154237A

United States Patent [19]

Kashino et al.

[11] Patent Number: 6,154,237

[45] **Date of Patent: *Nov. 28, 2000**

[54] LIQUID EJECTING METHOD, LIQUID EJECTING HEAD AND LIQUID EJECTING APPARATUS IN WHICH MOTION OF A MOVABLE MEMBER IS CONTROLLED

[75] Inventors: Toshio Kashino, Chigasaki; Takeshi Okazaki, Sagamihara; Aya Yoshihira; Kiyomitsu Kudo, both of Yokohama; Yoshie Asakawa, Hotakamachi, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/758,357

[22] Filed: Dec. 3, 1996

[30] Foreign Application Priority Data

Dec. 5, 1995 [JP] Japan ..... 7-316649
Jun. 7, 1996 [JP] Japan ..... 8-146257

[51] Int. Cl.[7] ..... B41J 2/14; B41J 2/05

[52] U.S. Cl. ..... 347/48; 347/65

[58] Field of Search ..... 347/48, 62, 65

[56] References Cited

U.S. PATENT DOCUMENTS

| | | | |
|---|---|---|---|
| 4,251,824 | 2/1981 | Hara et al. | 347/57 |
| 4,480,259 | 10/1984 | Kruger et al. . | |
| 4,723,129 | 2/1988 | Endo et al. . | |
| 4,994,825 | 2/1991 | Saito et al. . | |
| 5,208,604 | 5/1993 | Watanabe et al. . | |
| 5,278,585 | 1/1994 | Karz et al. | 347/65 |
| 5,389,957 | 2/1995 | Kimura et al. . | |
| 5,481,287 | 1/1996 | Tachihara | 347/62 |
| 5,731,828 | 3/1998 | Ishinaga | 347/48 X |

FOREIGN PATENT DOCUMENTS

| | | | |
|---|---|---|---|
| 0436047 | 7/1991 | European Pat. Off. | B41J 2/055 |
| 0630752 | 12/1994 | European Pat. Off. | B41J 2/05 |
| 55-81172 | 6/1980 | Japan | B41J 3/04 |
| 61-69467 | 4/1986 | Japan | B41J 3/04 |
| 62-238755 | 10/1987 | Japan | B41J 3/04 |
| 62-261453 | 11/1987 | Japan | B41J 3/04 |
| 63-197652 | 8/1988 | Japan | B41J 3/04 |
| 63-199972 | 8/1988 | Japan | F16K 15/14 |
| 1-237152 | 9/1989 | Japan | B41J 3/04 |

*Primary Examiner*—John Barlow
*Assistant Examiner*—J. Stephens
*Attorney, Agent, or Firm*—Fitzpatrick, Cella, Harper & Scinto

[57] ABSTRACT

A liquid ejecting method for ejecting liquid by generation of a bubble includes preparing a head comprising an ejection outlet for ejecting the liquid, a bubble generation region for generating the bubble in the liquid, a movable member disposed faced to the bubble generation region and displaceable between a first position and a second position further from the bubble generation region than the first position; displacing the movable member from the first position to the second position by pressure produced by the generation of the bubble in the bubble generating portion to permit expansion of the bubble more in a downstream side closer to the ejection outlet than in an upstream side; and wherein the displacing step including: first bubble generation step of displacing a free end side of the movable member by pressure produced by generation of a bubble in the bubble generating region; and second bubble generation step of generating at least one other bubble in the bubble generating region to eject the liquid through the ejection outlet.

52 Claims, 21 Drawing Sheets

LIQUID EJECTING METHOD, LIQUID EJECTING HEAD AND LIQUID EJECTING APPARATUS IN WHICH MOTION OF A MOVABLE MEMBER IS CONTROLLED

FIELD OF THE INVENTION AND RELATED ART

The present invention relates to a liquid ejecting method, a liquid ejecting head and a liquid ejecting apparatus, wherein desired liquid is ejected by generation of a bubble by application of thermal energy to the liquid.

More particularly, the present invention relates to a liquid ejecting head, liquid ejecting method and a liquid ejecting apparatus having a movable member displaceable by generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on, and is further applicable to industrial printing or recording apparatus, combined with various processing apparatus.

In this specification, "recording" means not only forming an image of letter, Figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129 and so on, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meed the demand, the optimization of the heat generating element such as adjustment of the thickness of the protecting film is investigated. This method is effective in that propagation efficiency of the generated heat to the liquid is improved.

In order to provide high quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No.

SHO-63-197652 and Japanese Laid Open Patent Application No. SHO-63-199972 propose flow passage structures as disclosed in FIG. 1, (*a*) and (*b*), for example. The flow passage structure or the head manufacturing method disclosed in this publication has been made noting a backward wave (the pressure wave directed away from the ejection outlet, more particularly, toward a liquid chamber 12) generated in accordance with generation of the bubble.

U.S. Pat. No. 5,278,585 disclosures a structure for suppressing the backward wave per se. On the other hand, in the bubble jet recording method, the heating is repeated with the heat generating element contacted with the ink, and therefore, a burnt material is deposited on the surface of the heat generating element due to burnt deposit of the ink. However, the amount of the deposition may be large depending on the materials of the ink. If this occurs, the ink ejection becomes unstable. Additionally, even when the liquid to be ejected is the one easily deteriorated by heat or even when the liquid is the one with which the bubble generated is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

Accordingly, it is a principal object of the present invention to provide a liquid ejecting method and a liquid ejecting head wherein a bubble generated is controlled, and is efficiently directly to the movable member, so that ejection efficiency and ejection power are increased.

It is another object of the present invention to provide a liquid ejecting method, liquid ejecting head or the like, wherein the ejection efficiency and the ejection power are further improved, and the heat accumulation in the liquid on heat generating element is significantly reduced, and in addition, the liquid is ejected in good order by reducing the residual bubble on the heat generating element.

It is a further object of the present invention to provide a liquid ejecting head or the like wherein an inertia, due to a backward wave, in a direction opposite from the liquid supply direction is suppressed, and simultaneously therewith, a meniscus retraction amount is reduced by a valve function of a movable member, so that refilling frequency is increased, and therefore, the printing speed or the like is improved.

It is a further object of the present invention to provide a liquid ejecting head and so on wherein deposition of residual material on the heat generating element is reduced, and the range of the usable liquid is widened, and in addition, the ejection efficiency and the ejection force are significantly increased.

It is a further object of the present invention to provide a liquid ejecting method, a liquid ejecting head and so on, wherein the choice of the liquid to be ejected is made greater.

According to an aspect of the present invention, there is provided a liquid ejecting method for ejecting liquid by generation of a bubble, comprising: preparing a head comprising an ejection outlet for ejecting the liquid, a bubble generation region for generating the bubble in the liquid, a movable member disposed faced to said bubble generation region and displaceable between a first position and a second position further from said bubble generation region than the first position; displacing said movable member from said first position to said second position by pressure produced by the generation of the bubble in said bubble generating portion to permit expansion of the bubble more in a downstream side closer to the ejection outlet than in an upstream side; and wherein said displacing step including: first bubble generation step of displacing a free end side of said movable member by pressure produced by generation of a bubble in said bubble generating region; and second bubble generation step of generating at least one other bubble in said bubble generating region to eject the liquid through the ejection outlet.

According to another aspect of the present invention, there is provided a liquid ejecting method for ejecting liquid by generation of a bubble, comprising: supplying the liquid along a heat generating element disposed along a flow path from upstream of the heat generating element; and applying heat generated by the heat generating element to the thus supplied liquid to generate a bubble, thus moving a free end of a movable member having the free end adjacent the ejection outlet side by pressure produced by the generation of the bubble, said movable member being disposed faced to said heat generating element; wherein said displacing step including: first bubble generation step of displacing a free end side of said movable member by pressure produced by generation of a bubble in said bubble generating region; and second bubble generation step of generating at least one other bubble in said bubble generating region to eject the liquid through the ejection outlet.

According to a further aspect of the present invention, there is provided a liquid ejecting method for ejecting liquid by generation of a bubble, comprising: preparing a head including a first liquid flow path in fluid communication with a liquid ejection outlet, a second liquid flow path having a bubble generation region and a movable member disposed between said first liquid flow path and said bubble generation region and having a free end adjacent the ejection outlet side; and generating a bubble in said bubble generation region to displace the free end of the movable member into said first liquid flow path by pressure produced by the generation of the bubble, thus guiding the pressure toward the ejection outlet of said first liquid flow path by the movement of the movable member to eject the liquid; wherein said displacing step including: first bubble generation step of displacing a free end side of said movable member by pressure produced by generation of a bubble in said bubble generating region; and second bubble generation step of generating at least one other bubble in said bubble generating region to eject the liquid through the ejection outlet.

According to a further aspect of the present invention, there is provided a liquid ejecting head comprising: an ejection outlet for ejecting the liquid; a bubble generation region for generating the bubble in the liquid; a movable member disposed faced to said bubble generation region and displaceable between a first position and a second position further from said bubble generation region than the first position; wherein said movable member moves from said first position to said second position by pressure produced by the generation of the bubble to permit expansion of the bubble more in a downstream side closer to the ejection outlet than in an upstream side; first bubble generation means for displacing a free end side of said movable member by pressure produced by generation of a bubble in said bubble generating region; and second bubble generation means for generating at least one other bubble in said bubble generating region to eject the liquid through the ejection outlet.

According to a further aspect of the present invention, there is provided a liquid ejecting head comprising: an ejection outlet for ejecting the liquid; a bubble generation region for generating the bubble in the liquid; a movable member disposed faced to said bubble generation region and having a downstream free end; wherein said movable member is displaced by first bubble generation step in said bubble generation region, and at least one other bubble is generated while said movable member is still in a displaced position to eject the liquid.

According to a further aspect of the present invention, there is provided a liquid ejecting apparatus for ejecting liquid, comprising: a liquid ejection head including an ejection outlet for ejecting the liquid; a bubble generation region for generating the bubble in the liquid; a movable member disposed faced to said bubble generation region and having a downstream free end; wherein said movable member is displaced by first bubble generation step in said bubble generation region, and at least one other bubble is generated while said movable member is still in a displaced position to eject the liquid.

According to the present invention, the movable member has already been shifted when the bubble for ejecting the liquid is generated, so that growth of the bubble at the free end side can be directed toward the ejection outlet side efficiently, thus improving the ejection efficiency and/or the ejection power.

These and other objects, features and advantages of the present invention will become more apparent upon a consideration of the following description of the preferred embodiments of the present invention taken in conjunction with the accompanying drawings.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the-bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

DETAILED DESCRIPTION OF THE PREFERRED EMBODIMENT

Referring to the accompanying drawings, the embodiments of the present invention will be described.

(Embodiment 1)

Figure 2:
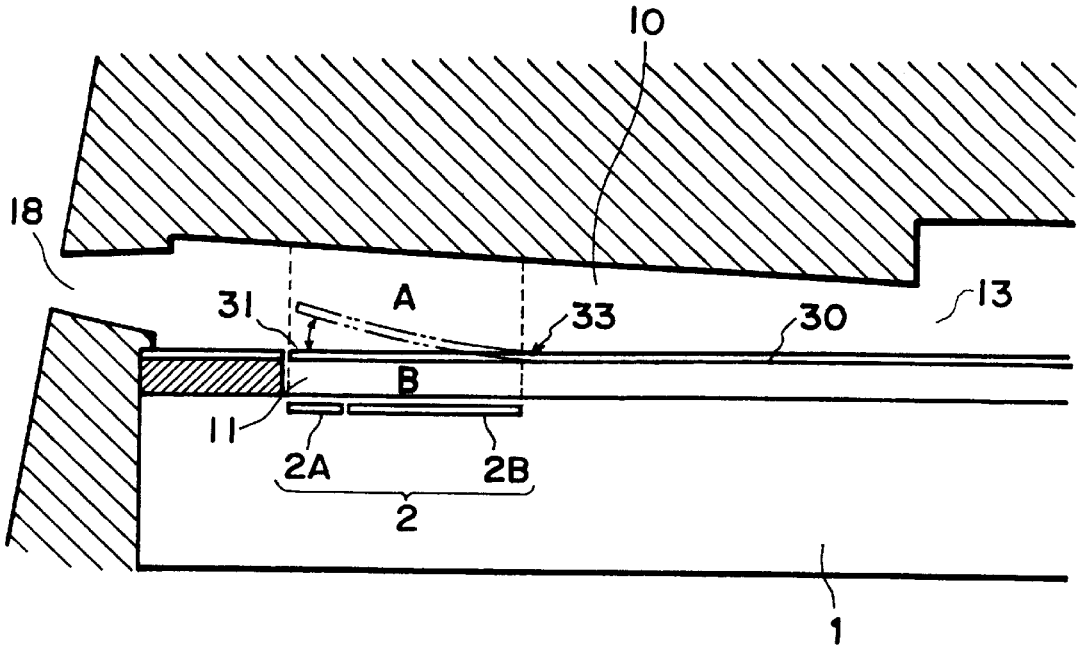
FIG. 2 is a schematic sectional view of an example of a liquid ejecting head according to an embodiment of the present invention.
Figure 3:
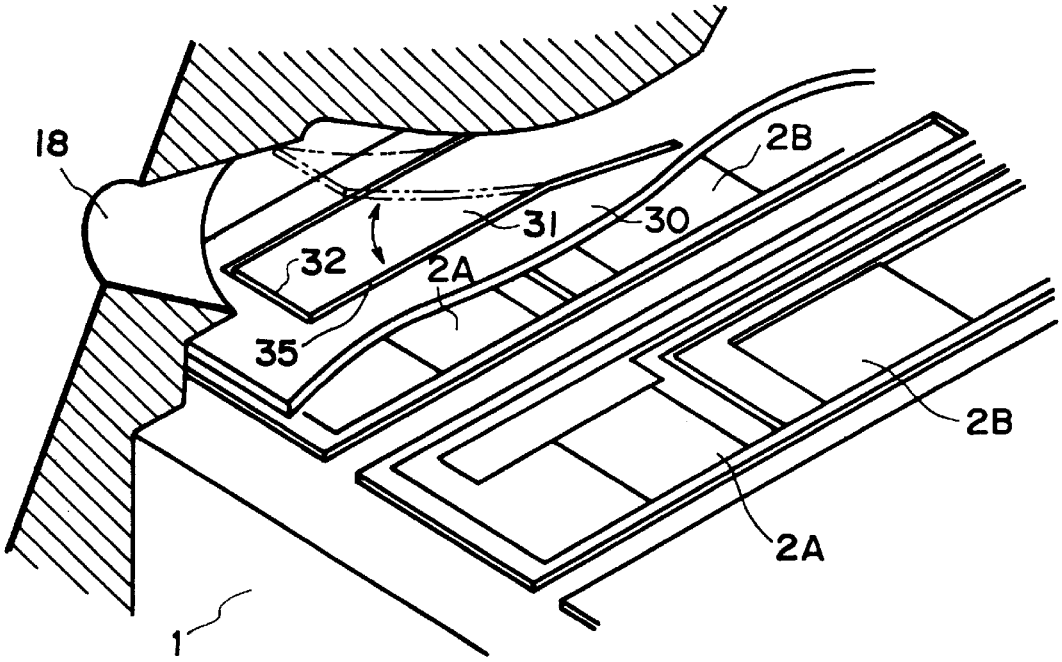
FIG. 3 is a partly broken perspective view of a liquid ejecting head according to an embodiment of the present invention.

In this embodiment, the description will be made as to an improvement in an ejection force and/or an ejection efficiency by controlling a direction of propagation of pressure resulting from generation of a bubble for ejecting the liquid and controlling a direction of growth of the bubble. FIG. 2 is a schematic sectional view of a liquid ejecting head taken along a liquid flow path according to this embodiment, and FIG. 3 is a partly broken perspective view of the liquid ejecting head. The liquid ejecting head of this embodiment comprises a heat generating element 2 (comprising a first heat generating element 2A and a second heat generating element 2B and having a dimension of 40 $\mu$m×105 $\mu$m as a whole in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18, respectively.

Above the element substrate in the liquid flow path 10, a movable member or plate 31 in the form of a cantilever of an elastic material such as metal is provided faced to the heat generating element 2. One end of the movable member is fixed to a foundation (supporting member) or the like provided by patterning of photosensitivity resin material on the wall of the liquid flow path 10 or the element substrate.

By this structure, the movable member is supported, and a fulcrum (fulcrum portion) 33 is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and so that it has a free end (free end portion) 32 in a downstream side of the fulcrum 33. The movable member 31 is faced to the heat generating element 2 with a gap of 15 $\mu$m approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that movable member 31 moves or displaces to widely open toward the ejection outlet side about the fulcrum 33. By the displacement of the movable member 31 or the state after the displacement, the propagation of the pressure caused by the generation of the bubble and the growth of the bubble per se are directed toward the ejection outlet.

Here, one of the fundamental ejection principles according to the present invention will be described. One of important principles of this invention is that movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream).

Figure 4:
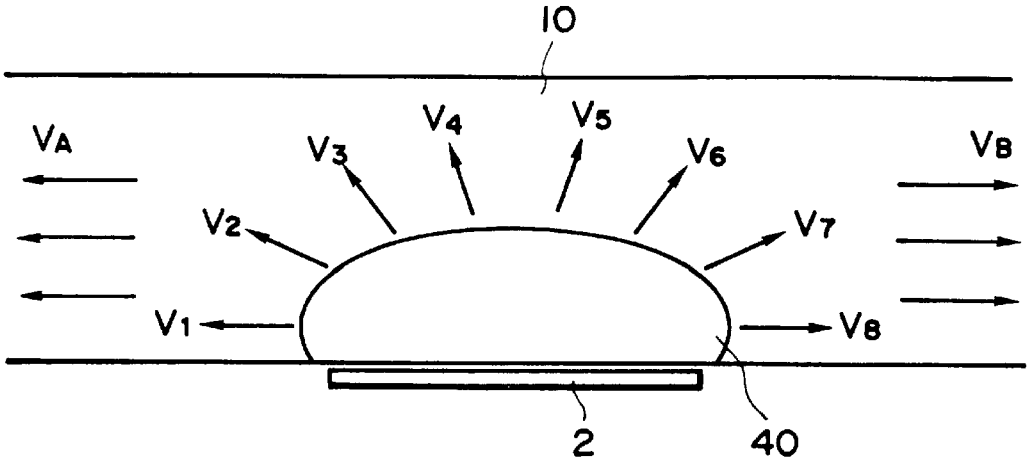
FIG. 4 is a schematic view showing pressure propagation from a bubble in a conventional head.
Figure 5:
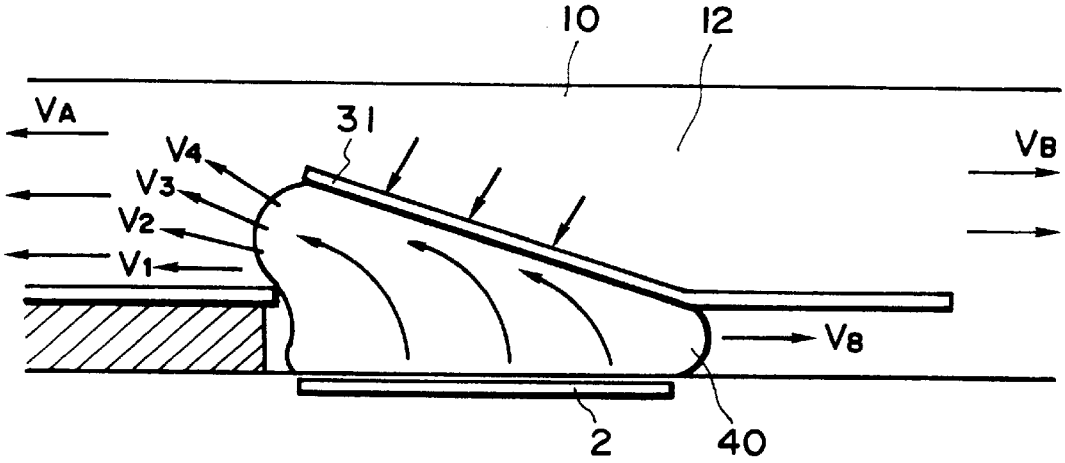
FIG. 5 is a schematic view showing pressure propagation from a bubble in a head according to an embodiment of the present invention.

More detailed description will be made with comparison between the conventional liquid flow passage structure not using the movable member (FIG. 4) and the present invention (FIG. 5). Here, the direction of propagation of the pressure toward the ejection outlet is indicated by $V_A$, and the direction of propagation of the pressure toward the upstream is indicated by $V_B$.

In a conventional head as shown in FIG. 4, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from substantially the half portion of the bubble closer to the ejection outlet (V1–V4), have the pressure components in the $V_A$ direction which is most effective for the liquid ejection. This portion is important since it is directly contributable to the liquid ejection efficiency, the liquid ejection pressure and the ejection speed. Furthermore, the component V1 is closest to the direction of $V_A$ which is the ejection direction, and therefore, the component is most effective, and the V4 has a relatively small component in the direction $V_A$.

On the other hand, in the case of the present invention, shown in FIG. 5, the movable member 31 is effective to direct, to the downstream (ejection outlet side), the pressure propagation directions V1–V4 of the bubble which otherwise are toward various directions. Thus, the pressure propagations of bubble 40 are concentrated so that pressure of the bubble 40 is directly and efficiently contributable to the ejection. The growth direction per se of the bubble is directed downstream similarly to the pressure propagation directions V1–V4, and the bubble grows more in the downstream side than in the upstream side. Thus, the growth direction per se of the bubble is controlled by the movable member, and the pressure propagation direction from the bubble is controlled thereby, so that ejection efficiency, ejection force and ejection speed or the like are fundamentally improved.

Referring to FIG. 6, the description will be made as to ejecting operation in the liquid ejecting head of this embodiment. In this embodiment, the driving pulse is as shown in FIG. 7. First, the first heat generating element 2A is supplied with predetermined size of pulse to generate such a bubble as is enough to displace the movable member but is not enough to eject the liquid. Then, simultaneously with deactuation of the first heat generating element 2A, the second heat generating element 2B is supplied with a pulse to generate such a bubble as is larger than that generated by the first heat generating element 2B and is enough to eject the liquid. Referring to FIG. 6, the description will be made as to the liquid ejection in this driving system.

FIG. 6, (*a*) shows a state before the energy such as electric energy is applied to the heat generating element 2, and therefore, no heat has yet been generated. The first heat generating element 2A is disposed at a position adjacent a free end side of the movable member 31, and the second heat generating element 2B is disposed adjacent a fixed end side thereof. It should be noted that movable member 31 is extended at least to a portion of the front heat generating element 2A in this liquid flow passage structure. As shown in FIG. 6, the operation efficiency of the movable member is higher when the movable member covers the heat generating element 2A.

FIG. 6, (*b*) shows a first bubble generation process, wherein the first heat generating element 2A is supplied with electric energy or the like, and the first heat generating element 2A generates heat by which a part of the liquid adjacent the free end side of the movable member 31 is heated in a bubble generating region 11, so that film boiling occurs to generate a bubble.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the-downstream side (ejection outlet side), and the fulcrum 33 is disposed in the upstream side (common liquid chamber side), so that at least a part of the movable member is faced to a part of the heat generating element 2A. This first bubble generation is not enough to eject the liquid but is enough to displace the movable member 31.

FIG. 6, (*c*) shows a state in which the second heat generating element 2B is supplied with electric energy or the like, and the second heat generating element 2B generates the heat by which a part of the liquid adjacent the movable member 31 fixed end is heated in the bubble generating region 11 to cause film boiling by which a bubble is generated. In embodiment, the second heat generating element 2B has an area larger than that of the first heat generating element 2A, and therefore, the bubble generated by the second heat generating element 2B is larger than that generated by the first one.

While the second bubble 41 is generated, the bubble 40 generated by the first heat generating element 2A reduces. However, the movable member 31 continues to displace by the pressure resulting from the bubble 41 generation.

FIG. 6, (*d*) shows a state in which the generated bubble 41 grows more toward the downstream than toward the upstream beyond the first position of the movable member. Here, since the movable member has already been opened by the pressure of the bubble 40 generated by the first heat generating element 2A, the pressure of the bubble 41 generated by the second heat generating element 2B, is directed toward the free end side. Therefore, by the movable member 31 displaced in accordance with the growth of the bubble 40, the direction of pressure propagation from the bubble 41 and the easy volume displacement direction, that is, the bubble growth direction toward the free end, are forced to be toward the ejection outlet. By this, the ejection efficiency is further increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

The movable member 31 having been displaced to the second position returns to the initial position (first position) by the restoring force provided by the spring property of the movable member per se and the negative pressure due to the contraction of the bubble. Upon the collapse of bubble, the liquid flows back from the common liquid chamber side and from the ejection outlet side so as to compensate for the volume reduction of the bubble in the bubble generation region 11 and to compensate for the volume of the ejected liquid.

In the foregoing, the description has been made as to the operation of the movable member 31 with the generation of the bubble and the ejecting operation of the liquid. Now, the description will be made as to the refilling of the liquid in the liquid ejecting head of the present invention. In the following description, the heat generating elements are deemed as being one heater, which generates one bubble, for the purpose of simplicity of explanation.

When the bubble 40 enters the bubble collapsing process after the maximum volume thereof, a volume of the liquid enough to compensate for the collapsing bubbling volume flows into the bubble generation region from the ejection outlet 18 side of the first liquid flow path 14 and from the common liquid chamber side 13 of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid).

Therefore, when the flow resistance at the ejection outlet side is small, a large amount of the liquid flows into the bubble collapse position from the ejection outlet side, with the result that meniscus retraction is large. With the reduction of the flow resistance in the ejection outlet for the purpose of increasing the ejection efficiency, the meniscus retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream of the second liquid flow path along the surface of the heat generating element side of the movable member 31 using the pressure upon the collapse of bubble, and therefore, more speedy refilling action is accomplished.

When the high speed refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function, too. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the inertia force. In this embodiment, these actions to the upstream side are suppressed by the movable member 31, so that refilling performance is further improved.

In this embodiment, the two heat generating elements are arranged in a direction of flow of the liquid toward the ejection outlet, but they may be arranged parallel.

Additional description will be made as to the structure and effect in the present invention.

With this structure, the supply of the liquid to the surface of the heat generating element 2 and the bubble generation region 11 occurs along the surface of the movable member 31 at the position closer to the bubble generation region 11. With this structure, the supply of the liquid to the surface of the heat generating element 2 and the bubble generation region 11 occurs along the surface of the movable member 31 at the position closer to the bubble generation region 11. Accordingly, stagnation of the liquid on the surface of the heat generating element 2 is suppressed, so that precipitation of the gas dissolved in the liquid is suppressed, and the residual bubbles not extinguished are removed without difficulty, and in addition, the heat accumulation in the liquid is not too much. Therefore, more stabilized generation of the bubble can be repeated at high speed. In this embodiment, the liquid supply passage 12 has a substantially flat internal wall, but this is not limiting, and the liquid supply passage is satisfactory if it has an internal wall with such a configuration smoothly extended from the surface of the heat generating element that stagnation of the liquid occurs on the heat generating element, and eddy flow is not significantly caused in the supply of the liquid.

The supply of the liquid into the bubble generation region may occur through a gap at a side portion of the movable member (slit 35). In order to direct the pressure upon the bubble generation further effectively to the ejection outlet, a large movable member covering the entirety of the bubble generation region (covering the surface of the heat generating element) may be used, as shown in FIG. 2. Then, the flow resistance for the liquid between the bubble generation region 11 and the region of the first liquid flow path 14 close to the ejection outlet is increased by the restoration of the movable member to the first position, so that flow of the liquid to the bubble generation region 11 can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 8:
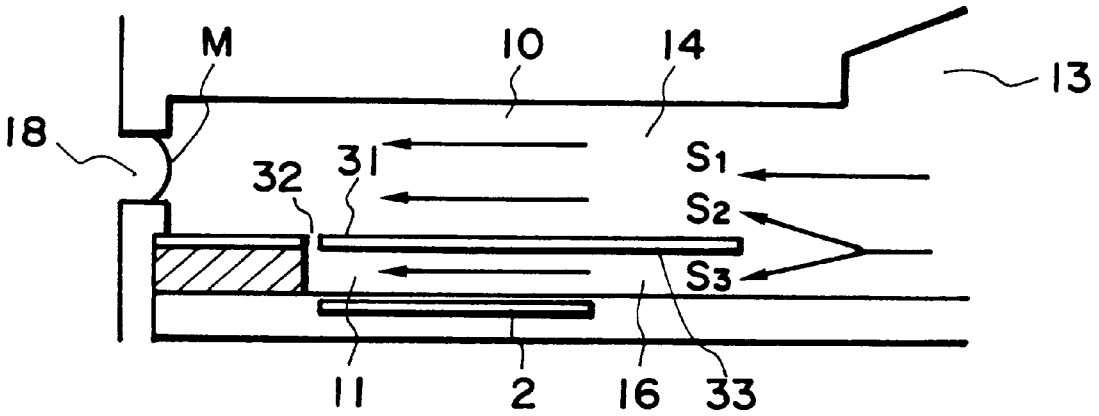
FIG. 8 is a schematic view illustrating flow of liquid in an embodiment of the present invention.

The positional relation between the free end 32 and the fulcrum 33 of the movable member 31 is such that free end is at a downstream position of the fulcrum as shown in FIG. 8, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted b the ejection as shown in FIG. 8, returns to the ejection outlet 18 by capillary force or when the liquid supply is effected to compensate for the collapse of bubble, the positions of the free end and the fulcrum 33 are such that flows $S_1$, $S_2$ and $S_3$ through the liquid flow path 10 including the first liquid flow path 14 and the second liquid flow path 16, are not impeded.

As has been described hereinbefore, in FIG. 2 showing the embodiment of the present invention, the movable member 31 is extended so that free end 32 thereof is faced to at least a part of the heat generating element 2A which is disposed closer to the ejection outlet.

Further advantageous effects are provided using the upstream side of the bubble, as described hereinbefore.

In the structure of this embodiment, the instantaneous mechanical displacement of the free end of the movable member 31 is considered as contributing to the ejection of the liquid.

As described in the foregoing, in this embodiment, the movable member is opened by the bubble generated by the first heat generating element, and while the movable member is open, a new bubble is then generated by the second heat generating element, and therefore, the component of the bubble generation pressure necessary for the displacement of the movable member, can be directed and grown toward the ejection outlet from an early stage of the bubble generation. As a result, higher ejection power and ejection efficiency can be provided.

Figure 9:
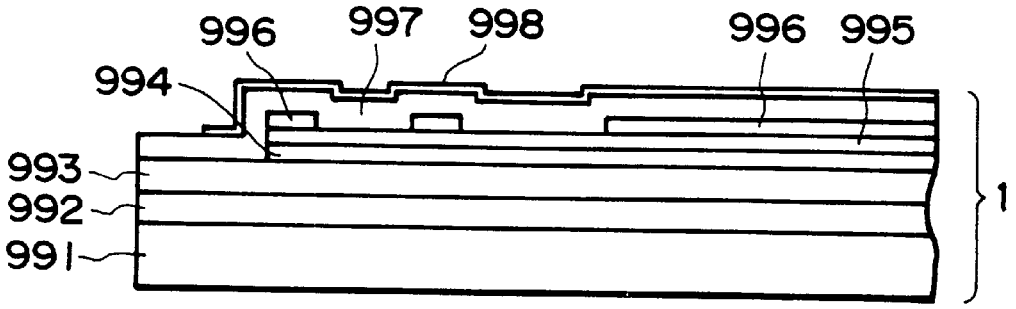
FIG. 9 is a schematic sectional view illustrating a modified example of a first liquid flow path of a liquid ejecting head.

FIG. 9 shows a structure, adjacent the heat generating portion, of a head according to an embodiment of the present invention, and in this Figure, reference numeral 1 designates an element substrate, and reference numeral 991 designates a silicon portion of the substrate. On this silicon portion 991, two layers of silicon oxide ($SiO_2$) are provided, and one is designated by reference numeral 992 (1.5 μm thick), and the other is designated by reference numeral 993 (1.4 μm thick).

On these layers, a heat generating resistor layer 994 ($HfB_2$, 0.05 μm) having a heat generating portion, and a metal film 995 (Ti, 0.005 μm), are provided. On the metal film 995, there are provided a distribution electrode layer 996 (Al, 0.55 μm), a protecting film 997 ($SiO_2$, 1.0 μm) and a protecting film 998 (Ta, 0.23 μm). The head having the structures adjacent the heat generating portion described above and having the structures of the flow path and movable member as has been described hereinbefore, is driving with a driving voltage of 24 V. In this embodiment. By applying a pulse of a pulse width of 5 μsec to the first heat generating element and applying a pulse of a pulse width of 10 μsec to the second heat generating element, the liquid can be ejected while the movable member is in the displaced state.

In order to make the pulse width longer, the film structure adjacent the heat generating portion is changed so as to promote the heat accumulation, by which the bubble generation state can last longer.

In FIG. 6, (*b*) and (*d*), a part of the bubble generated in the bubble generation region of the second liquid flow path 16 with the displacement of the movable member 31 to the first liquid flow path 14 side, extends into the first liquid flow path 14 side. By selecting the height of the second flow path to permit such extension of the bubble, the ejection force is further improved as compared with the case without such extension of the bubble. To provide such extending of the bubble into the first liquid flow path 14, the height of the second liquid flow path is preferably lower than the height of the maximum bubble, more particularly, the height is preferably several μm—30 μm, for example. In this embodiment, the height is 15 μm.

Figure 10:
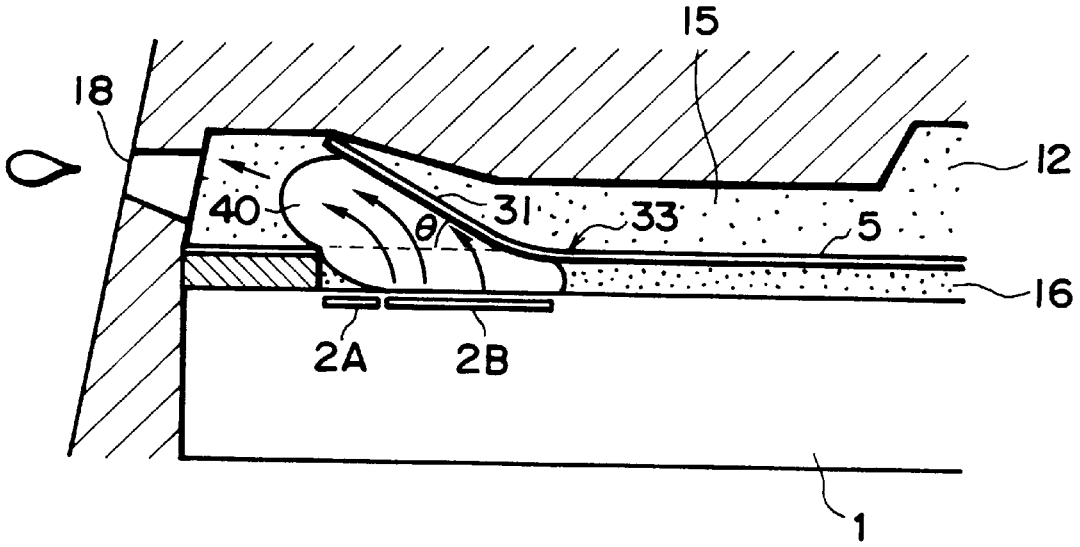
FIG. 10 is a schematic sectional view illustrating a relation among a movable member of a liquid ejecting head, bubble and ejection liquid in an embodiment of the present invention.
Figure 11:
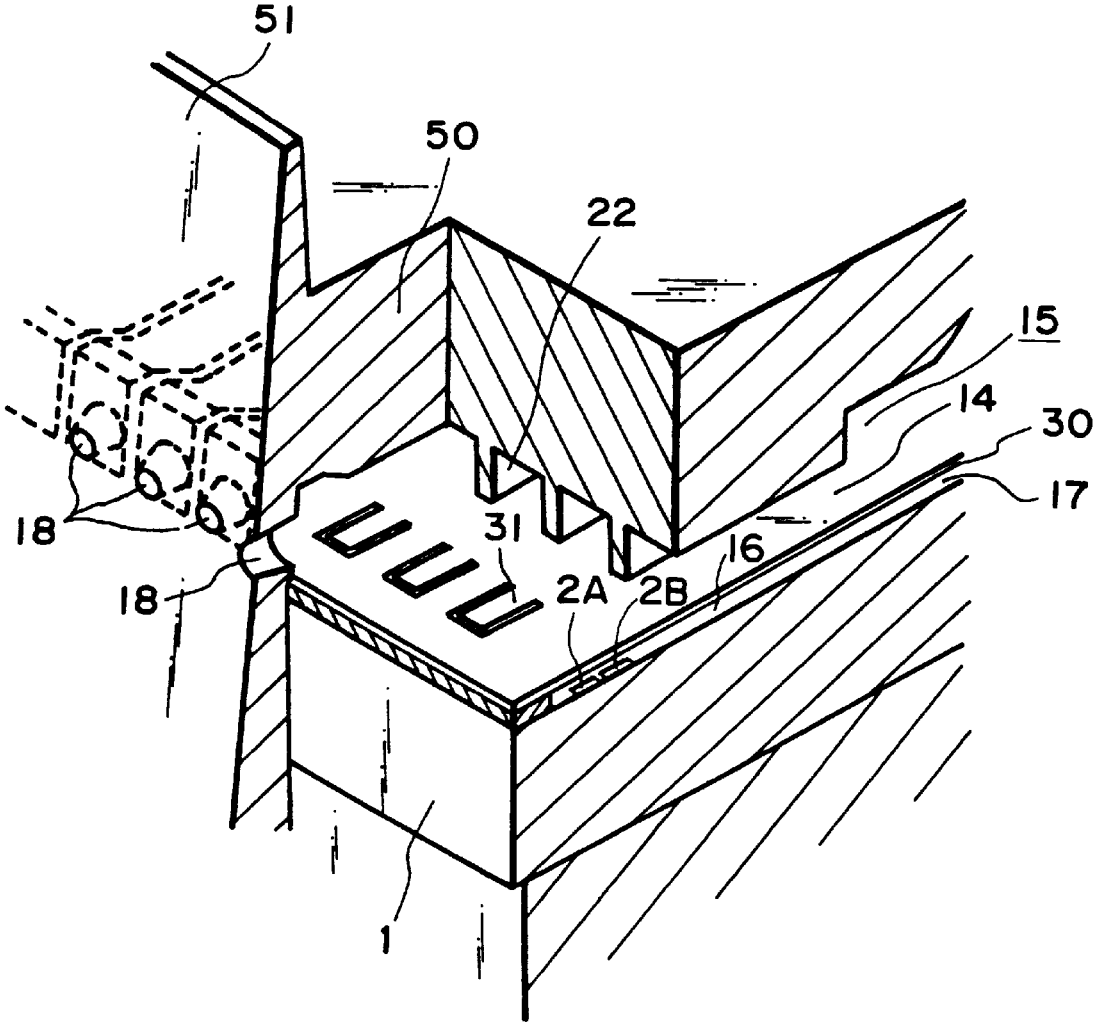
FIG. 11 is a partly exploded perspective view of a liquid ejecting head in an embodiment of the present invention.

FIGS. 10 and 11 show a modified example of the first liquid flow path, wherein the ceiling adjacent the free end of the movable wall is higher to permit larger movable angle θ of the movable member 31. The movable range of the movable member may be determined on the basis of the structures of the flow path, the durability of the movable member, the bubble generation power and/or the like. It is preferable that angle is wide enough to include the direction of the ejection outlet.

In the above-described embodiment, the first liquid flow path and the second liquid flow path are supplied with the same inks. However, the ejection liquid and the bubble generation liquid may be different liquids. However, it is desirable that mixture of the liquids are not adversely influential to the recording even if the bubble generation liquid is mixed into the ejection liquid, since it may occur during the continuous bubble generations.

As described in the foregoing, according to the structure of this example, most of the pressure produced by the generation of the bubble can be efficiently transmitted directly to the ejection outlet side by the movable member, and in addition, the time loss resulting from the closing action of the movable member is short in the continuous bubble generations and ejections. Therefore, the liquid can be ejected at high speed with high ejection efficiency and with high ejection power.

With the structure wherein the second liquid flow path in which the generation of the bubble occurs, and the first liquid flow path from which the ink is ejected, are separate, the pressure (pressure wave) generated in the second liquid flow path can be directed concentratedly to the movable member side. Since the pressure can be directed continuously toward the ejection outlet by the movable member, and therefore, the ejection efficiency and the ejection power can be further enhanced. With this structure, much of the pressure wave transmitted to the first liquid flow path is directed along the ejection, and in the first liquid flow path, the backward wave per se is very small, so that refilling is efficient.

(Embodiment 2)

In Embodiment 1, as shown in FIGS. 6 and 7, the control is effected such that duration of actuation of the first heat generating element 2A and the duration of actuation of the second heat generating element 2B, are not overlapped. Therefore, simultaneously with start of collapse of the first bubble, the second bubble is generated. During the period from the generation of the second bubble to the bubble collapse thereof, the first bubble is not created again. In Embodiment 2, as shown in FIGS. 12 and 13, the second heat generating element 2B generates the bubble simultaneously with bubble collapse start of the bubble generated by the first heat generating element 2A, and while the second bubble exists, the first heat generating element 2A is reactuated to increase the size of the second bubble by merger. In this manner, following the upward displacement of the movable member by the first heat generating element 2A, the liquid is ejected by the bubble generated by a combination of the second heat generating element 2B and the first heat generating element 2A. Therefore, propagation of the bubble pressure can be further strongly directed toward the ejection outlet, and therefore, the ejection power is further enhanced.

Referring to FIG. 12, more detailed description will be made.

FIG. 12, (*a*) shows a state before the energy such as electric energy is applied to the heat generating element 2, and therefore, no heat has yet been generated. Similarly to the foregoing embodiment, the first heat generating element 2A is disposed at a position adjacent a free end side of the movable member 31, and the second heat generating element 2B is disposed adjacent a fixed end side thereof. It should be noted that movable member 31 is extended at least to a portion of the front heat generating element 2A in this liquid flow passage structure. The operation efficiency of the movable member is higher when the movable member covers the heat generating element 2A. FIG. 12, (*b*) shows a first bubble generation process, wherein the first heat generating element 2A is supplied with electric energy or the like, and the first heat generating element 2A generates heat by which a part of the liquid adjacent the free end side of the movable member 31 is heated in a bubble generating region 11, so that film boiling occurs to generate a bubble.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element. This first bubble generation is not enough to eject the liquid but is enough to displace the movable member 31.

FIG. 12, (*c*) shows a state in which the second heat generating element 2B is supplied with electric energy or the like, and the second heat generating element 2B generates the heat by which a part of the liquid adjacent the movable member 31 fixed end is heated in the bubble generating region 11 to cause film boiling by which a bubble is generated. In embodiment, the second heat generating element 2B has an area larger than that of the first heat generating element 2A, and therefore, the bubble generated by the second heat generating element 2B is larger than that generated by the first one.

While the second bubble 41 is generated, the bubble 40 generated by the first heat generating element 2A reduces. However, the movable member 31 continues to displace by the pressure resulting from the bubble 41 generation.

As shown in FIG. 12, (*d*), while the bubble 41 generated by the second heat generating element 2B is still growing, the first heat generating element 2A is reactuated to generate the bubble. The bubbles are merged into one large bubble, which growths more toward downstream than toward upstream. Since the movable member is already opened by the pressure of the bubble 40 generated by the first heat generating element 2A, the pressure of the bubble generated by the second heat generating element 2B and the first heat generating element 2A, is directed toward the free end side of the movable member 31. The ejection efficiency is more enhanced than in Embodiment 1.

(Embodiment 3)

In Embodiments 1 and 2, the second heat generating element 2B provided upstream has a larger size than the first heat generating element 2A provided downstream, and the bubble per se for ejection of the liquid is generated by the second heat generating element 2B. In Embodiment 3, the second heat generating element 2B provided at the upstream is smaller than the first heat generating element 2A provided at the downstream, and the bubble 40 per se for ejecting the liquid is generated by the first heat generating element 2A. Thus, in this embodiment, the bubble 41 generated by the second heat generating element 2B is used as a so-called bubble buffer. Therefore, the growth, to the upstream, of the bubble 40 generated by the first heat generating element 2A is suppressed by the pressure of the bubble generated by the second heat generating element 2B, and is pushed to the downstream (the free end side of the movable member 31) by the pressure, and the bubble per se generated by the first heat generating element 2A. Is directed to the free end.

(Embodiment 4)

Figure 15:
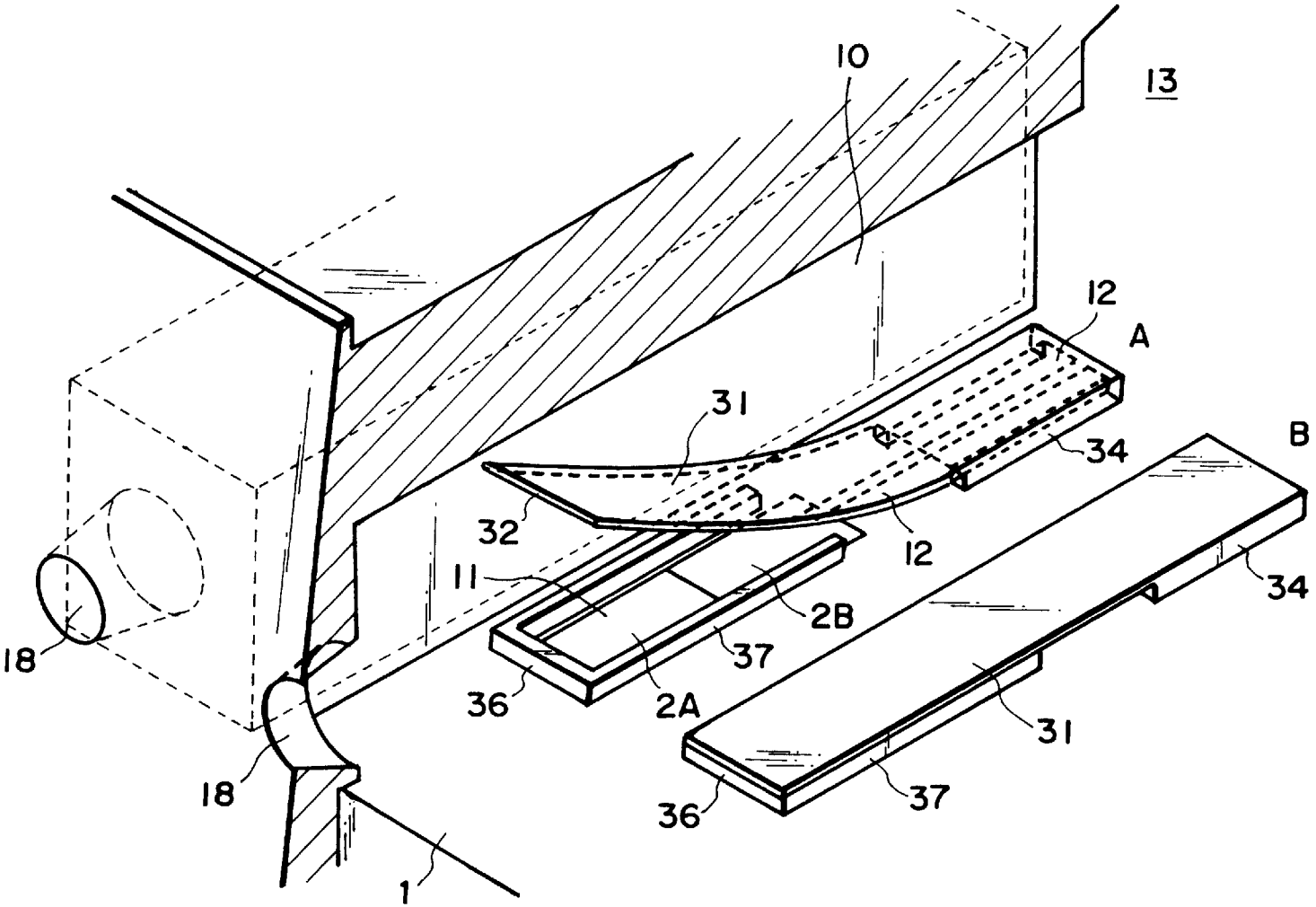
FIG. 15 is a partly broken perspective view of a liquid ejecting head according to an embodiment of the present invention.

FIG. 15 shows a device of a fourth embodiment of the present invention. In FIG. 15, A shows a state in which the movable member is displaced (the bubble is not shown), and B shows a state in which the movable member takes the initial or home position (first position), which state is called "substantially hermetically sealed state" for the bubble generation region 11 from the ejection outlet 18 (although not shown in the Figure, a flow passage wall is provided between A and B to separate the flow paths). In Embodiment 4, first heat generating element and second heat generating element constitute one heat generating element means similarly to Embodiments 1–3, they are deemed as one heat generating element 2 for the sake of simplicity of description and illustration.

The movable member 31 in FIG. 15 is set on two lateral foundations 34, and a liquid supply passage 12 is provided therebetween. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that ejection outlet 18 side of the bubble generation region 11 is substantially sealed. Thus, the pressure produced by the bubble at the time-of the bubble generation and particularly the pressure downstream of the bubble, can be concentrated on the free end side of the movable member, without releasing the pressure.

At the time of the collapse of bubble, the movable member 31 returns to the first position, the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing embodiment.

In this embodiment, the foundation 34 for supporting and fixing the movable member 31 is provided at an upstream position away from the heat generating element 2, and the foundation 34 has a width smaller than the liquid flow path 10 to supply the liquid to the liquid supply passage 12. The configuration of the foundation 34 is not limited to this structure, but may be anyone if smooth refilling is accomplished.

In this embodiment, the clearance between the movable member 31 and the heat generating element 2, was approx. 15 $\mu$m, but may be different if the pressure on the basis of the generation of the bubble is sufficiently transmitted to the movable member.

(Embodiment 5)

Figure 16:
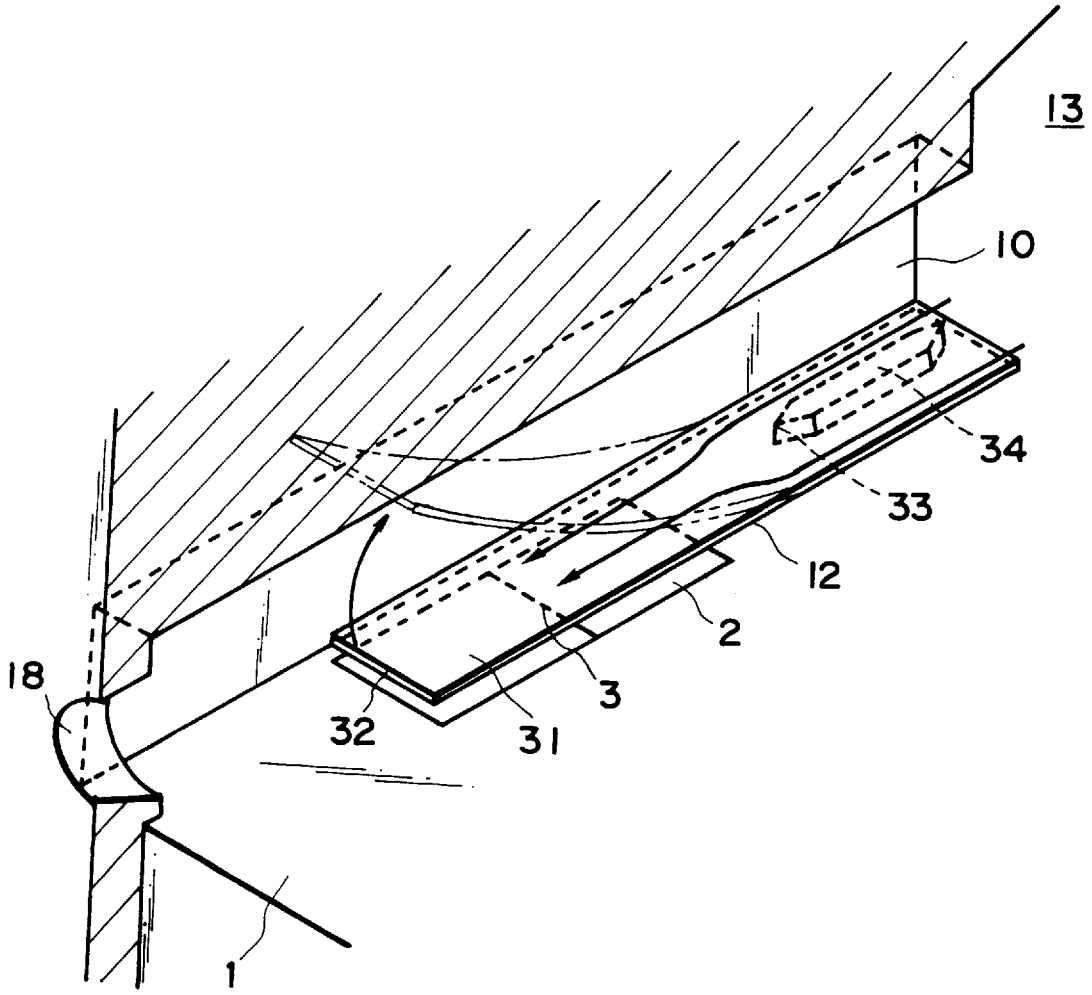
FIG. 16 is a partly broken perspective view of a liquid ejecting head according to an embodiment of the present invention.

FIG. 16 shows a device of a fifth embodiment. More particularly, FIG. 16 shows positional relation among the bubble generating region, bubble generation there and the movable member in one liquid flow path. In Embodiment 5, first heat generating element and second heat generating element constitute one heat generating element means similarly to Embodiments 1–4, they are deemed as one heat generating element 2 for the sake of simplicity of description and illustration.

In most of the foregoing examples, the pressure of the bubble generated is concentrated toward the free end of the movable member, by which the movement of the bubble is concentrated to the ejection side, simultaneously with the abrupt motion of the movable member. In this embodiment, a latitude is given to the generated bubble, and the downstream portion of the bubble (at the ejection outlet side of the bubble) which is directly influential to the droplet ejection, is regulated by the free end side of the movable member.

As compared with FIG. 2 (first embodiment), the head of FIG. 16 does not include a projection (hatched portion) as a barrier at a downstream end of the bubble generating region on the element substrate 1 of FIG. 2. In other words, the free end region and the opposite lateral end regions of the movable member, is open to the ejection outlet region without substantial sealing of the bubble generating region in this embodiment.

Of the downstream portion of the bubble directly contributable to the liquid droplet ejection, the downstream leading end permits the growth of the bubble, and therefore, the pressure component thereof is effectively used for the ejection. In addition, the pressure directed upwardly at least in the downstream portion (component force of VB in FIG. 3) functions such that free end portion of the movable member is added to the bubble growth at the downstream end portion. Therefore, the ejection efficiency is improved, similarly to the foregoing embodiment. As compared with the foregoing embodiments, the structure of this embodiment is better in the responsivity of the driving of the heat generating element.

In addition, the structure is simple so that manufacturing is easy.

The fulcrum portion of the movable member 31 in this embodiment, is fixed to one foundation 34 having a width smaller than the surface portion of the movable member. Therefore, the liquid supply to the bubble generation region 11 upon the collapse of bubble occurs along both of the lateral sides of the foundation (indicated by an arrow). The foundation may be in another form if the liquid supply performance is assured.

In the case of this embodiment, the existence of the movable member is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the third embodiment, both of the lateral sides (or only one lateral side) are substantially sealed for the bubble generation region 11. With such a structure, the pressure toward the lateral side of the movable member is also directed to the ejection outlet side end portion, so that ejection efficiency is further improved.

(Embodiment 6)

Figure 17:
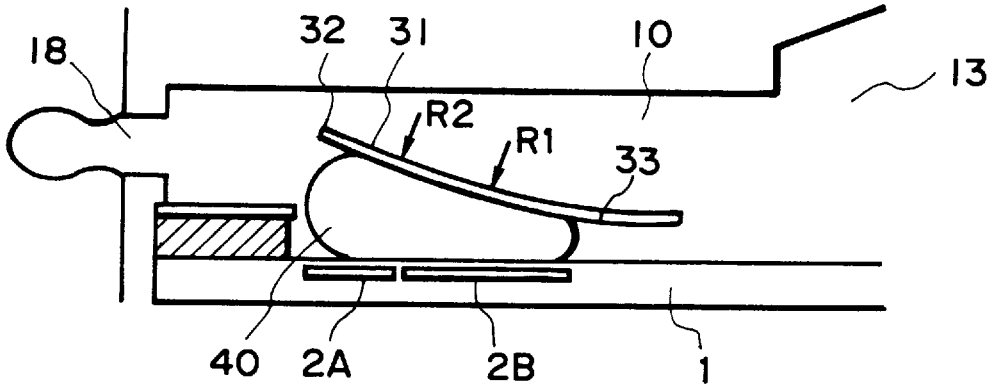
FIG. 17 is a sectional view of a liquid ejecting head according to an embodiment of the present invention.

In this embodiment, the ejection power for the liquid by the mechanical displacement is further enhanced. FIG. 17 is a cross-sectional view of such a head structure. In FIG. 17, the movable member is extended such that position of the free end of the movable member 31 is positioned further downstream of the ejection outlet side end of the heat generating element. By this, the displacing speed of the movable member at the free end position can be increased, and therefore, the production of the ejection power by the displacement of the movable member is further improved.

In addition, the free end is closer to the ejection outlet side than in the foregoing embodiment, and therefore, the growth of the bubble can be concentrated toward the stabilized direction, thus assuring the better ejection.

In response to the growth speed of the bubble at the central portion of the pressure of the bubble, the movable member 31 displaces at a displacing speed R1. The free end 32 which is at a position further than this position from the fulcrum 33, displaces at a higher speed R2. Thus, the free end 32 mechanically acts on the liquid at a higher speed to increase the ejection efficiency.

The free end configuration is such that, as is the same as in FIG. 16, the edge is vertical to the liquid flow, by which the pressure of the bubble and the mechanical function of the movable member are more efficiently contributable to the ejection.

(Embodiment 7)

A further embodiment will be described.

In this embodiment, the same ejection principle is used, and the liquid wherein the bubble generation is carried out (bubble generation liquid), and the liquid which is mainly ejected (ejection liquid) are separated.

Figure 18:
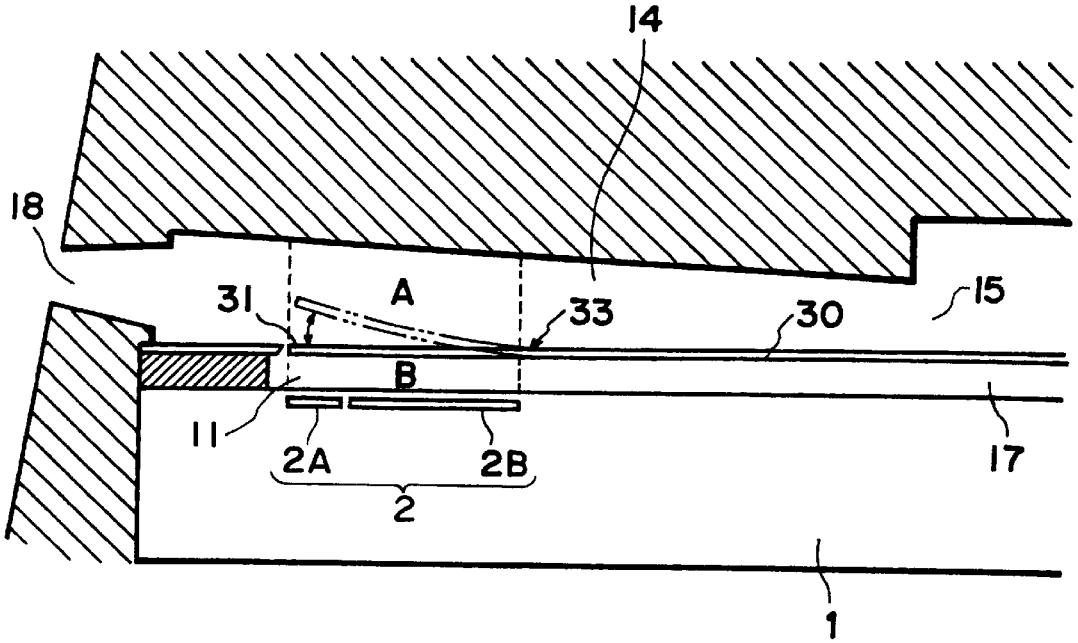
FIG. 18 is a sectional view of a liquid ejecting head (two path) according to an embodiment of the present invention.

FIG. 18 is a schematic sectional view, in a direction of flow of the liquid, of the liquid ejecting head according to this embodiment.

In the liquid ejecting head, there is provided a second liquid flow path 17 for the bubble generation liquid on an element substrate 1 provided with a heat generating element 2 for applying thermal energy for generating the bubble in the liquid, and there is further provided, on the second liquid flow path 17, a first liquid flow path 14 for the ejection liquid, in direct communication with the ejection outlet 18.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that bubble generation liquid and ejection liquid are the same liquids, the number of the common liquid chambers may be one.

Between the first and second liquid flow paths, there is a separation wall 30 of an elastic material such as metal so that first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

The movable member 31 is in the form of a cantilever wherein such a portion of separation wall as is in an upward projected space of the surface of the heat generating element (ejection pressure generating region, region A and bubble generating region 11 of the region B in FIG. 18) constitutes a free end by the provision of the slit 35 at the ejection outlet side (downstream with respect to the flow of the liquid), and the common liquid chamber (15, 17) side thereof is a fulcrum or fixed portion 33. This movable member 31 is located faced to the bubble generating region 11 (B), and therefore, it functions to open toward the ejection outlet side of the first liquid flow path upon bubble generation of the bubble generation liquid (in the direction indicated by the arrow, in the Figure). In an example of FIG. 2, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Figure 19A:
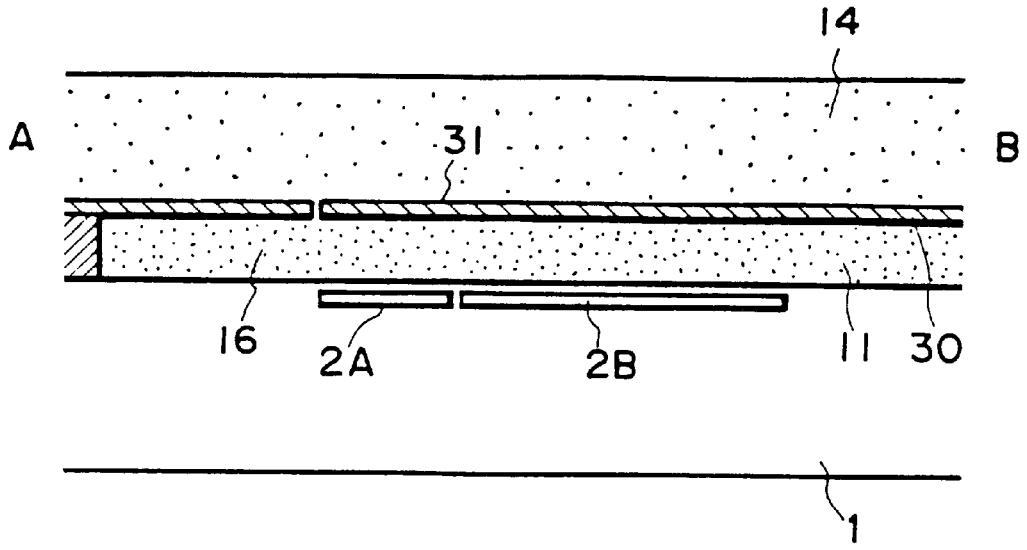
FIGS. 19 (*a*) and 19 (*b*) illustrate an operation of a movable member.
Figure 19B:
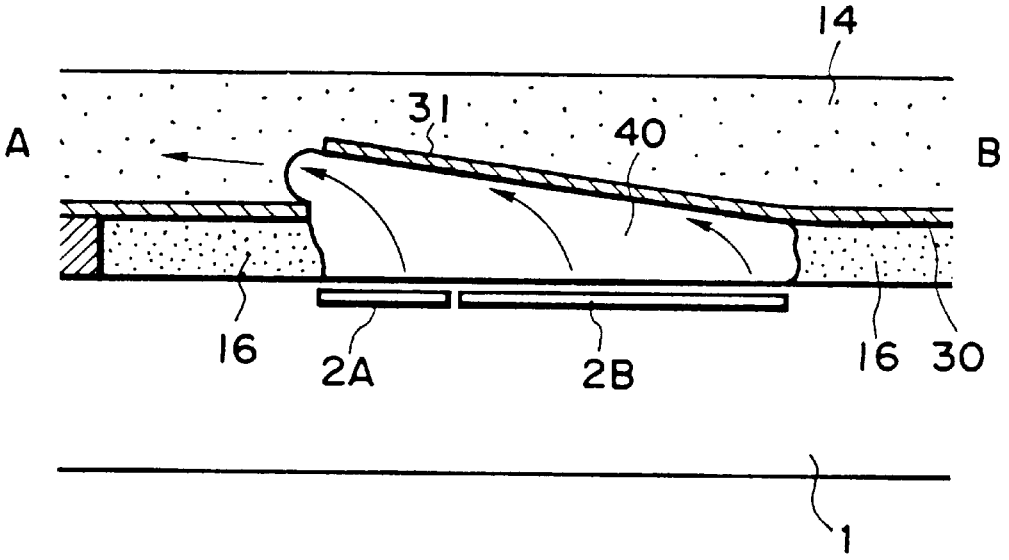

Referring to FIG. 19, the operation of the liquid ejecting head of this embodiment will be described. In this embodiment, first heat generating element and second heat generating element constitute one heat generating element means similarly to the foregoing Embodiments, they are deemed as one heat generating element 2 for the sake of simplicity of description and illustration.

The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore (U.S. Pat. No. 4,723,129).

In this embodiment, the bubble generation pressure is not released in the three directions except for the upstream side in the bubble generation region, so that pressure produced by the bubble generation is propagated concentratedly on the movable member 6 side in the ejection pressure generation portion, by which the movable member 6 is displaced from the position indicated in FIG. 17, (*a*) toward the first liquid flow path side as indicated in FIG. 19, (*b*) with the growth of the bubble. By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Then, with the contraction of the bubble, the movable member 31 returns to the position indicated in FIG. 19, (*a*), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path as the bubble generation liquid. An example of the bubble generation liquid a mixture liquid (1–2 cP approx.) of ethanol and water (4:6). By doing so, the ejection liquid can be properly ejected.

Additionally, by selecting as the bubble generation liquid a liquid with which the deposition such as burnt deposit does not remain on the surface of the heat generating element even upon the heat application, the bubble generation is stabilized to assure the proper ejections.

The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the heat and with which the bubble generation is in good order, is supplied in the second liquid flow path. By doing so, the liquid can be ejected without thermal damage and with high ejection efficiency and with high ejection pressure.

(Other Embodiments)

The description will be made as to additional embodiments. In the following, either a single-flow-path type or two-flow-path type will be taken, but any example is usable for both unless otherwise stated. In this embodiment, first heat generating element and second heat generating element constitute one heat generating element means similarly to the foregoing Embodiments, they are deemed as one heat generating element 2 for the sake of simplicity of description and illustration.

<Positional relation between second liquid flow path and movable member>

Figure 20A:
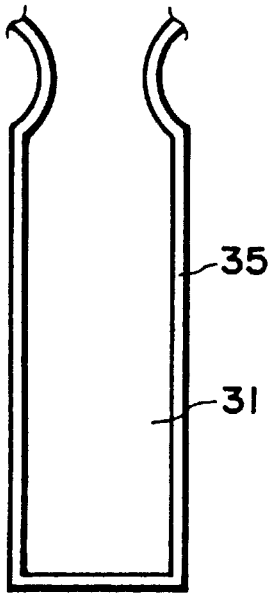
FIGS. 20 (*a*) through 20 (*c*) illustrate structures of a movable member and liquid flow path.
Figure 20B:
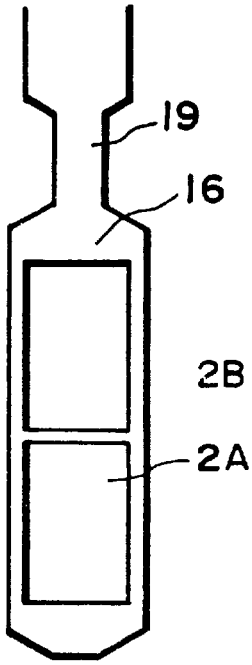

FIG. 20 is an illustration of a positional relation between the above-described movable member 31 and second liquid flow path 16, and (a) is a view of the movable member 31 position of the partition wall 30 as seen from the above, and (b) is a view of the second liquid flow path 16 seen from the above without partition wall 30. FIG. 15, (*c*) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that filling amount of the bubble generation liquid to the bubble generation region 11 may be small. Therefore, the clearance at the throat portion 19 can be made very small, for example, as small as several $\mu$m—ten and several $\mu$m, so that release of the pressure produced in the second liquid flow path can be further suppressed and to further concentrate it to the movable member side. The pressure can be used as the ejection pressure through the movable member 31, and therefore, the high ejection energy use efficiency and ejection pressure can be accomplished. The configuration of the first liquid flow path 16 is not limited to the one described above, but may be any if the pressure produced by the bubble generation is effectively transmitted to the movable member side.

As shown in FIG. 20, (*c*), the lateral sides of the movable member 31 cover respective parts of the walls constituting the second liquid flow path so that falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

Figure 21A:
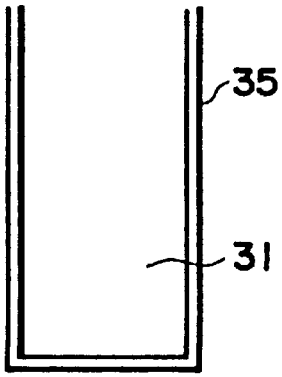
FIGS. 21 (*a*) through 21 (*c*) illustrate another configuration of the movable member.
Figure 21B:
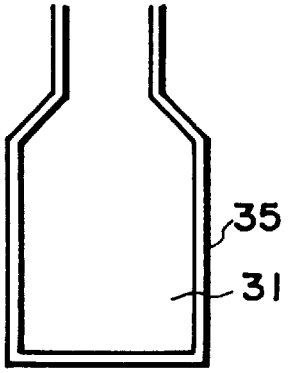
Figure 21C:
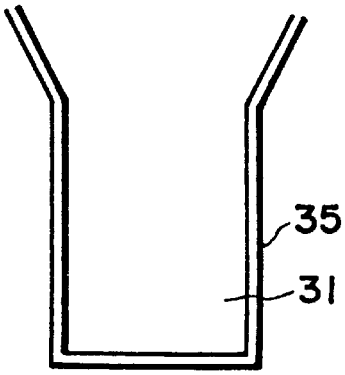
Figure 23:
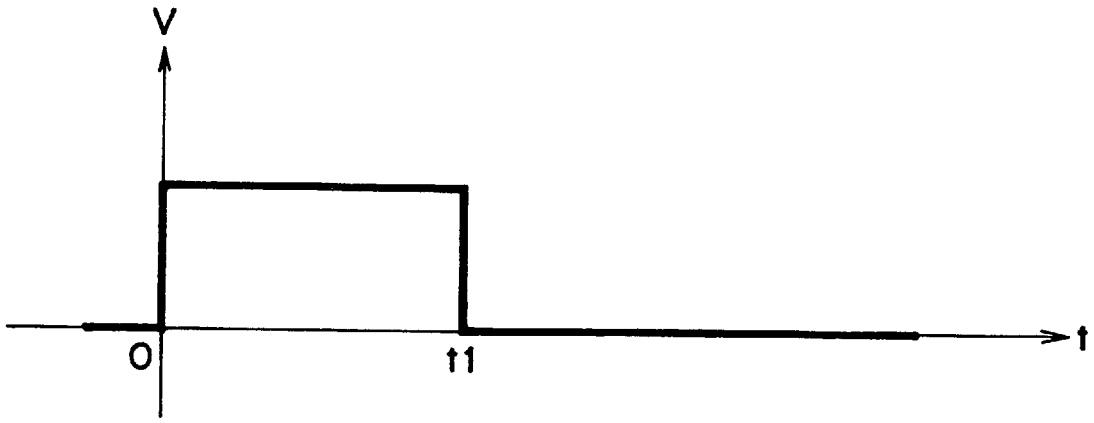
FIG. 23 is a schematic view showing a configuration of a driving pulse.

In FIG. 23, (*b*) and FIG. 21, a part of the bubble generated in the bubble generation region of the second liquid flow path 4 with the displacement of the movable member 6 to the first liquid flow path 14 side, extends into the first liquid flow path 14 side. By selecting the height of the second flow path to permit such extension of the bubble, the ejection force is further improved as compared with the case without such extension of the bubble. To provide such extending of the bubble into the first liquid flow path 14, the height of the second liquid flow path 16 is preferably lower than the height of the maximum bubble, more particularly, the height is preferably several $\mu$m—30 $\mu$m, for example. In this embodiment, the height is 15 $\mu$m.

<Movable member and partition wall>

FIG. 21 shows another example of the movable member 31, wherein reference numeral 35 designates a slit formed in the partition wall, and the slit is effective to provide the movable member 31. In the Figure, (a), the movable member has a rectangular configuration, and in (b), it is narrower in the fulcrum side to permit increased mobility of the movable member, and in (c), it has a wider fulcrum side to enhance the durability of the movable member. The configuration narrowed and arcuated at the fulcrum side is desirable as shown in FIG. 20, (*a*), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 $\mu$m, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. Slit is enough to avoid the liquid mixture, but not more than 3 μm is desirable.

The slit providing the "substantial sealing", preferably has several microns width, since the liquid mixture prevention is assured.

<Element substrate>

The description will be made as to a structure of the element substrate provided with the heat generating element for heating the liquid.

Figure 22A:
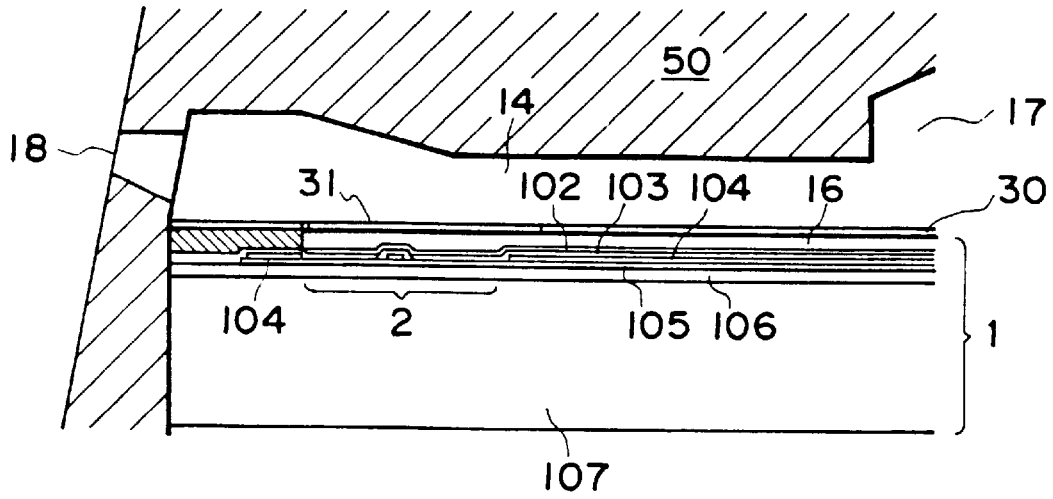
FIGS. 22 (*a*) and 22 (*b*) are longitudinal sectional views of a liquid ejecting head according to an embodiment of the present invention.
Figure 22B:
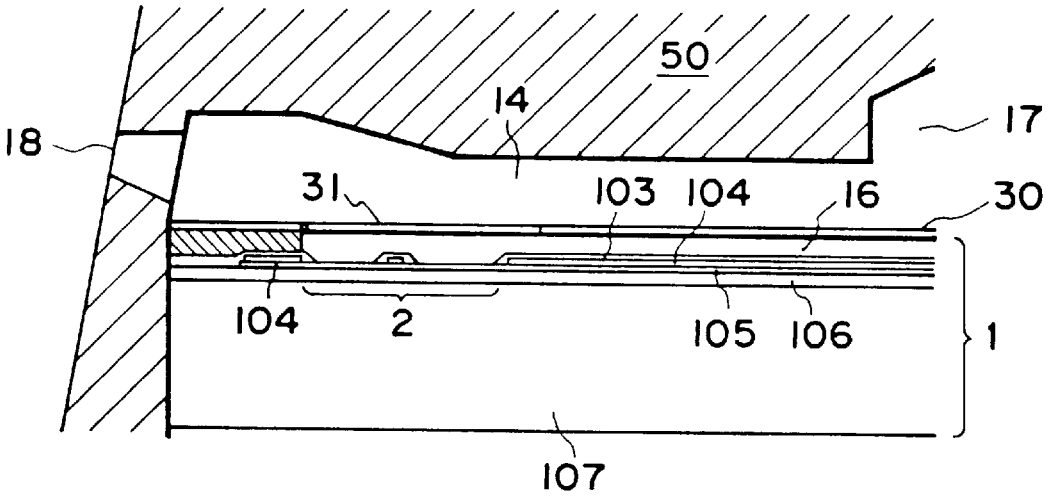

FIG. 22 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 12, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 22, (*b*). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selectively driving the electrothermal transducer element may also be integrally built in, in addition to the resistance layer 105 constituting the heat generation portion and the electrothermal transducer constituted by the wiring electrode 104 for supplying the electric signal to the resistance layer.

In order to eject the liquid by driving the heat generation portion of the electrothermal transducer on the above-described element substrate 1, the resistance layer 105 is supplied through the wiring electrode 104 with rectangular pulses as shown in FIG. 23 to cause instantaneous heat generation in the resistance layer 105 between the wiring electrode. In the case of the heads of the foregoing embodiments, the applied energy has a voltage of 24 V, a pulse width of 5 μsec, for the first heat generating element, and a pulse width 10 μsec for the second heat generating element at the timed relation as described hereinbefore to drive the heat generating element, by which the liquid ink is ejected through the ejection outlet through the process described hereinbefore. However, the driving signal conditions are not limited to this, but may be any if the bubble generation liquid is properly capable of bubble generation.

<Head structure for 2 flow paths>

The description will be made as to a structure of the liquid ejecting head with which different liquids are separately accommodated in first and second common liquid chamber, and the number of parts can be reduces so that manufacturing cost can be reduced.

Figure 24:
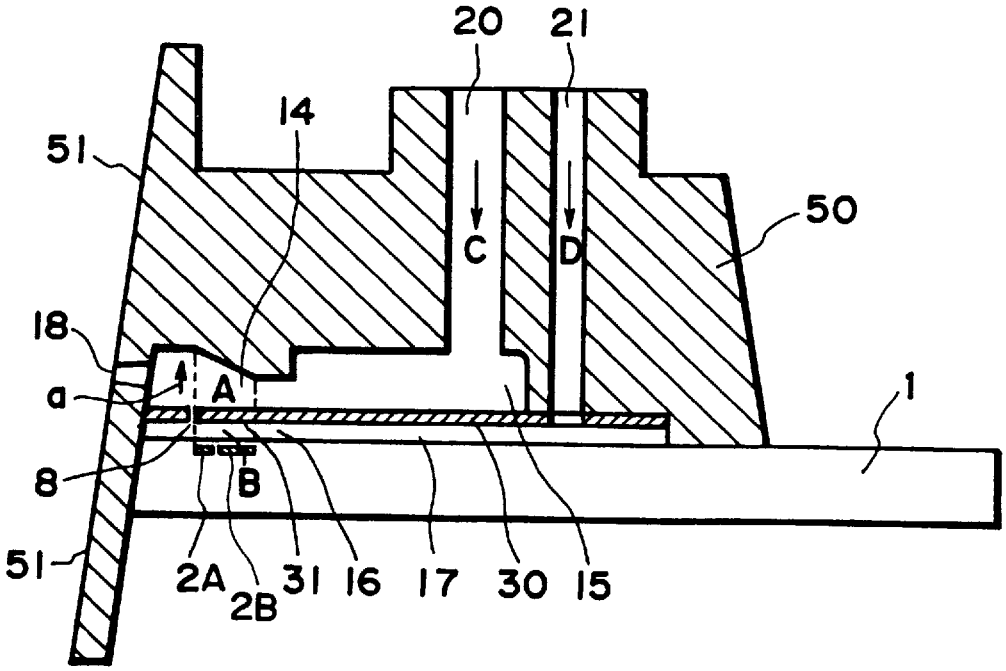
FIG. 24 is a sectional view illustrating a supply passage of a liquid ejecting head according to an embodiment of the present invention.
Figure 25:
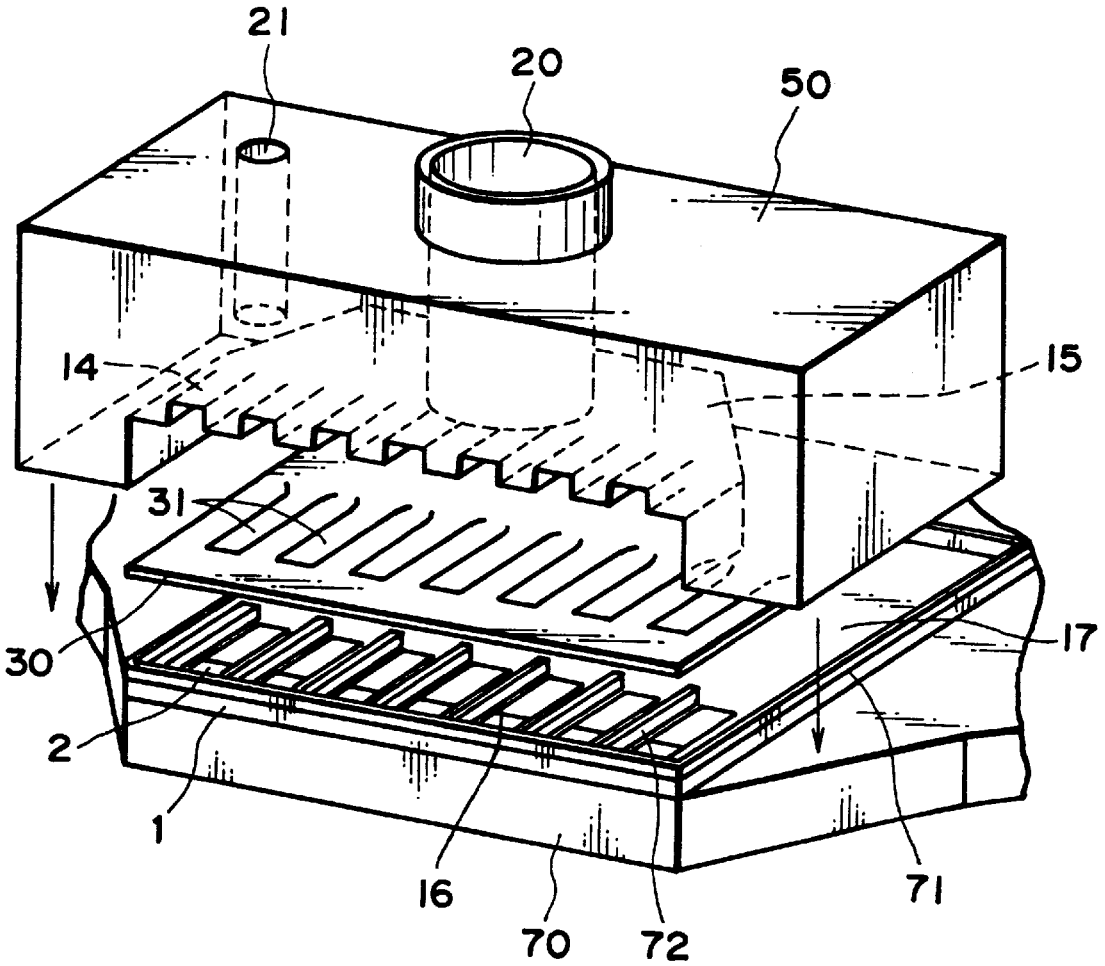
FIG. 25 is an exploded perspective view of a head according to an embodiment of the present invention.

FIG. 24 is a schematic view of such a liquid ejecting head, and FIG. 25 is an exploded perspective view. In FIG. 25, orifice plate has been removed. The same reference numerals as in the previous embodiment are assigned to the elements having the corresponding functions, and detailed descriptions thereof are omitted for simplicity.

In this embodiment, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14.

A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

As indicated by an arrow C in FIG. 24, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 22.

In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

Figure 26:
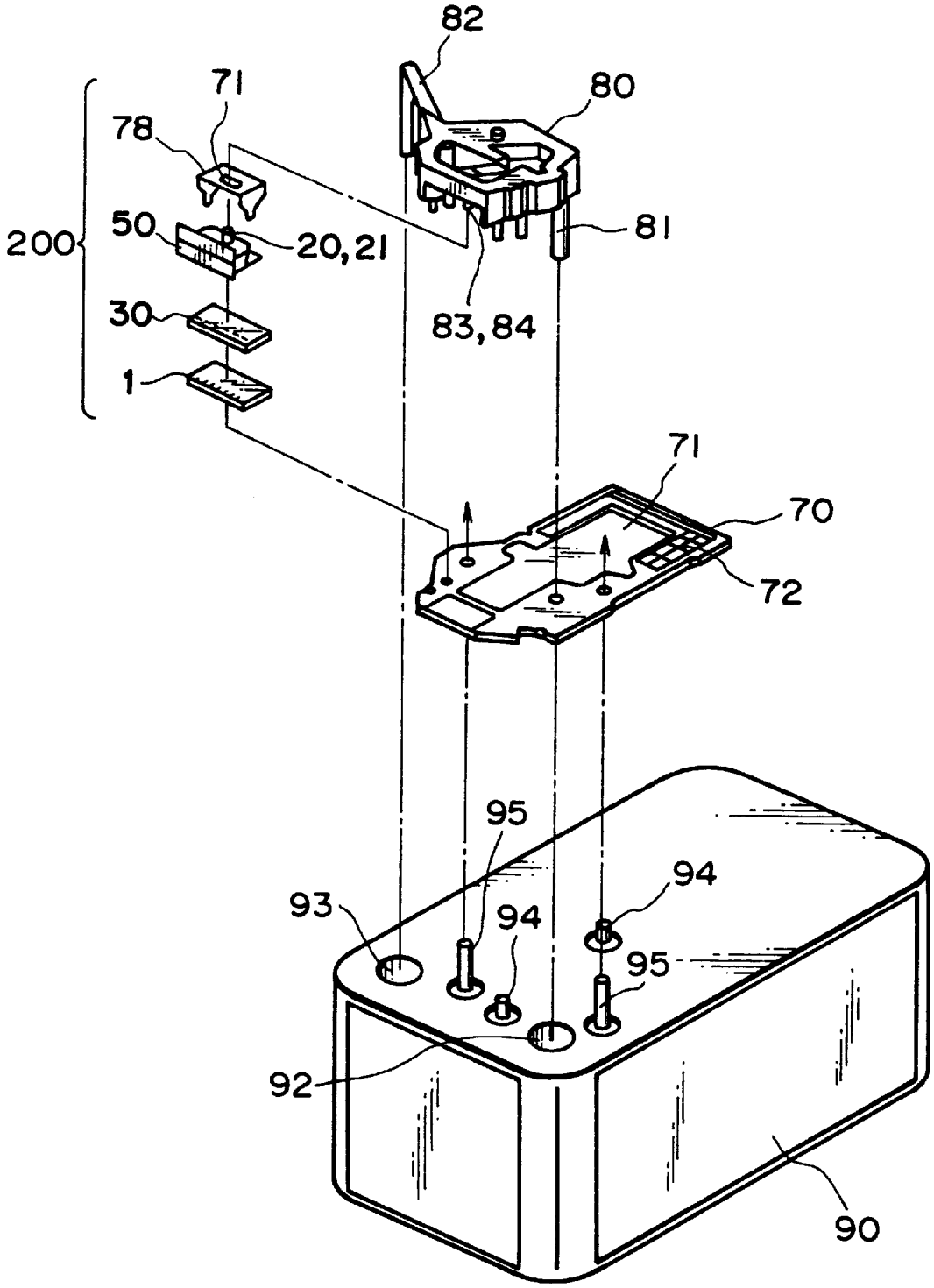
FIG. 26 is an exploded perspective view of a liquid ejection head cartridge.

The second common liquid chamber 17 may be formed by dividing the grooved by a separation wall 30. As for the method of forming this, as shown in FIG. 26 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second common liquid chamber 17. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that movable members 31 are arranged corresponding to the heat generating elements on the element substrate 1, and that ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount.

By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that stabilized ejection is accomplished.

<Ejection liquid and bubble generation liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n- n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

Dye ink viscosity of 2cp

| | |
|---|---|
| (C.I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150cps liquid was properly ejected to provide high quality image.

Bubble generation liquid 1:

| | |
|---|---|
| Ethanol | 40 wt. % |
| Water | 60 wt. % |

Bubble generation liquid 2:

| | |
|---|---|
| Water | 100 wt. % |

Bubble generation liquid 3:

| | |
|---|---|
| Isopropyl alcoholic | 10 wt. % |
| Water | 90 wt. % |

Ejection liquid 1:

| Pigment ink approx. 15 cp | |
|---|---|
| Carbon black | 5 wt. % |
| Stylene-acrylate-acrylate ethyl copolymer resin material | 1 wt. % |
| Dispersion material (oxide 140, weight average molecular weight) | |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |

Ejection liquid 2 (55cp):

| | |
|---|---|
| Polyethylene glycol 200 | 100 wt. % |

Ejection liquid 3 (150cp):

| | |
|---|---|
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Liquid ejection head cartridge>

The description will be made as to a liquid ejection head cartridge having a liquid ejecting head according to an embodiment of the present invention.

FIG. 26 is a schematic exploded perspective view of a liquid ejection head cartridge including the above-described liquid ejecting head, and the liquid ejection head cartridge comprises generally a liquid ejecting head portion 200 and a liquid container 80.

The liquid ejecting head portion 200 comprises an element substrate 1, a separation wall 30, a grooved member 50, a confining spring 78, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 78 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 84 of the connecting member from the ejection liquid supply passage 92 of the liquid container, and is supplied to a first common liquid chamber through the ejection liquid supply passages 83, 71 and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members.

In such a liquid ejection head cartridge, even if the bubble generation liquid and the ejection liquid are different liquids, the liquids are supplied in good order. In the case that ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and the liquid container may be integral with each other or separate from each other.

<Liquid ejecting device>

Figure 27:
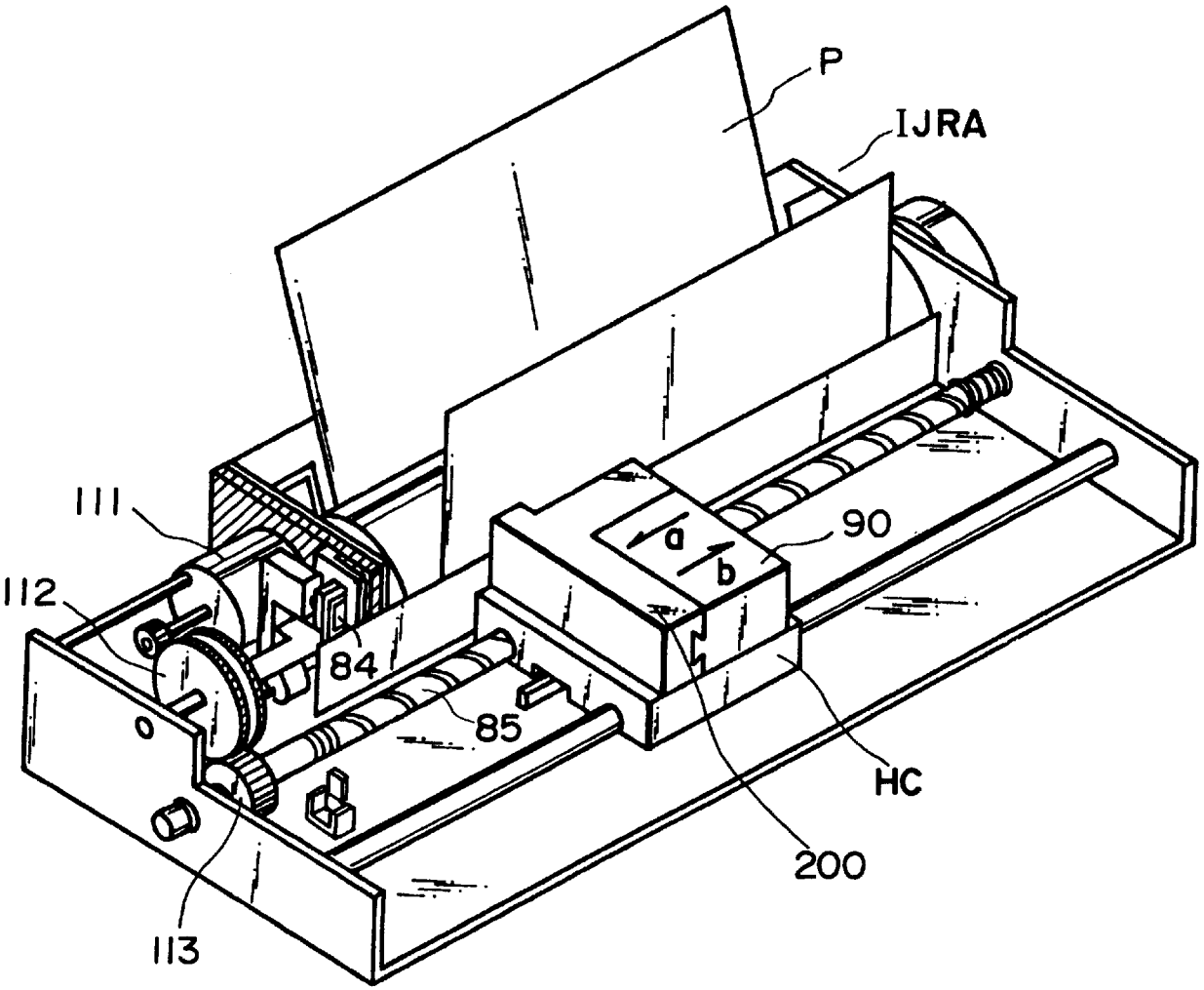
FIG. 27 is a schematic illustration of a liquid ejecting apparatus.

FIG. 27 is a schematic illustration of a liquid ejecting device used with the above-described liquid ejecting head. In this example, the ejection liquid is ink. The apparatus is an ink ejection recording apparatus. The liquid ejecting device comprises a carriage HC to which the head cartridge comprising a liquid container portion 90 and liquid ejecting head portion 201 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 11 1 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 28:
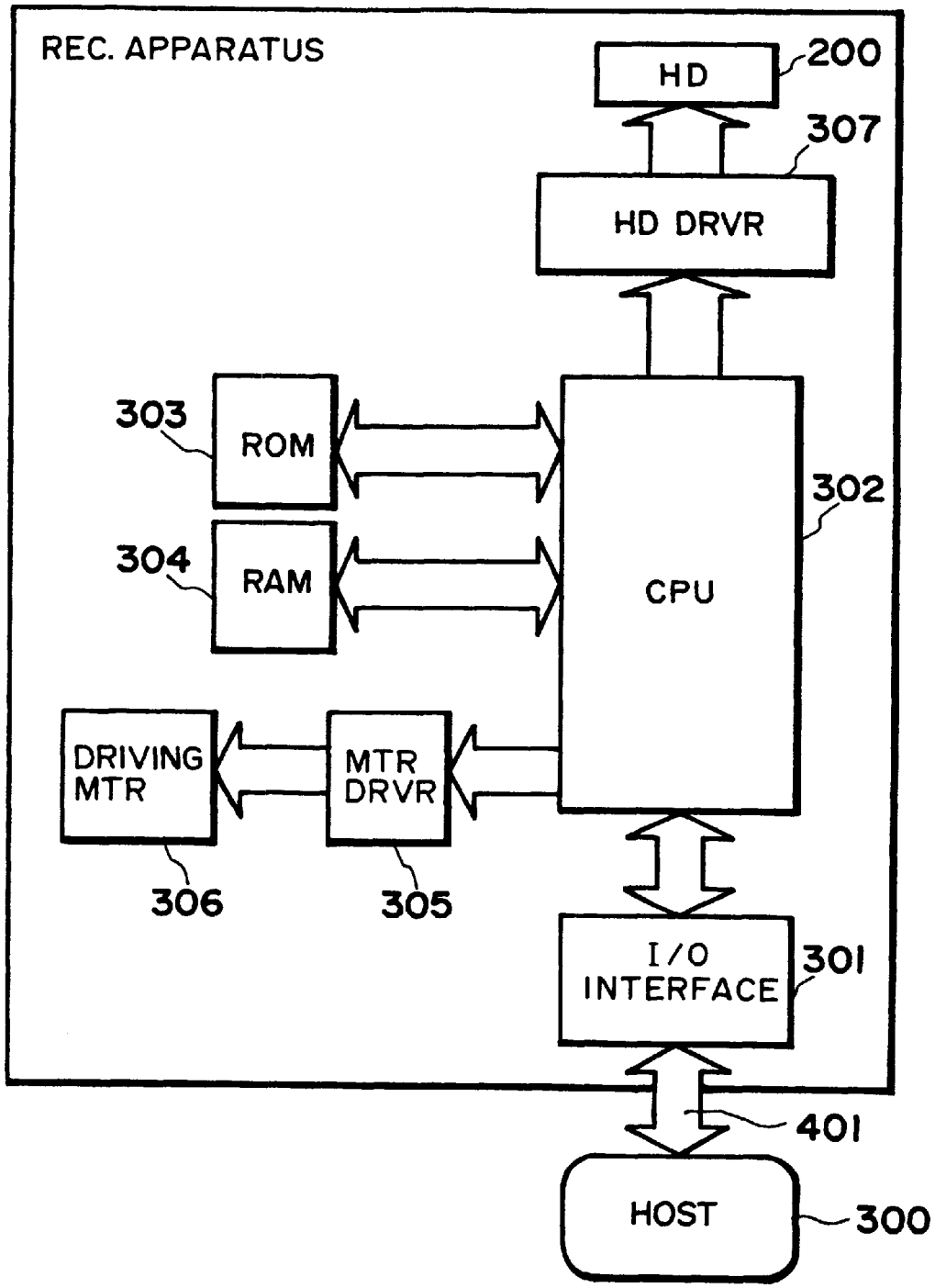
FIG. 28 is a device block diagram.

FIG. 28 is a block diagram of the entirety of the device for carrying out ink ejection recording using the liquid ejecting head and the liquid ejecting method of the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

<Recording System>

Next, an exemplary ink jet recording system will be described, which records images on recording medium, using, as the recording head, the liquid ejection head in accordance with the present invention.

Figure 29:
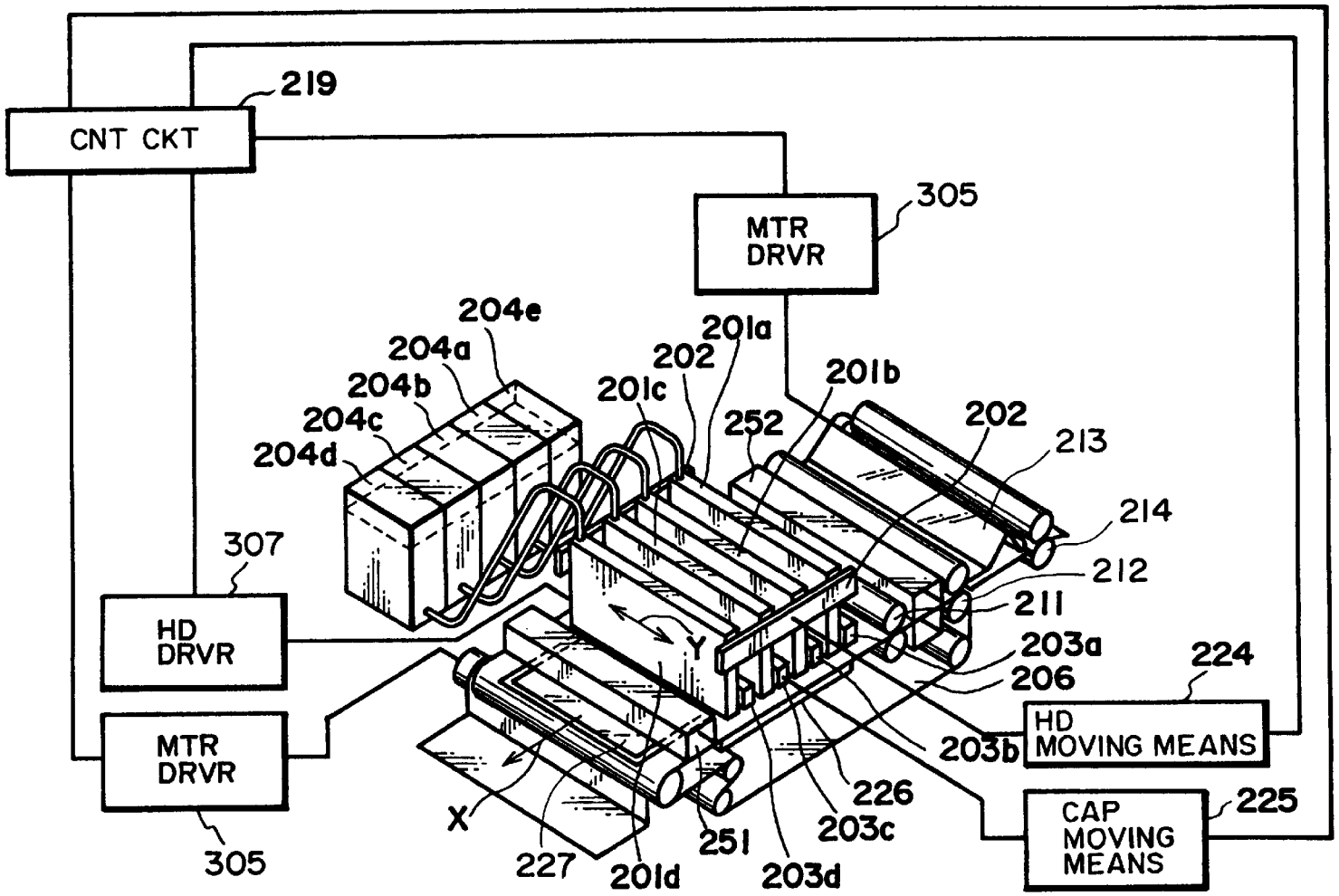
FIG. 29 is a diagram of a liquid ejection recording system.

FIG. 29 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a*, 204*b*, 205*c* or 204*d*. A reference numeral 204*e* designates a bubble generation liquid container from which the bubble generation liquid is delivered to each head.

Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface.

In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

With the use of the ejection principle using the movable member, most of the pressure due to the generation of the bubble can be directly and efficiently transmitted by the movable member, and therefore, high ejection efficiency and ejection power can be accomplished.

The ejection failure can be avoided even after long term non-use under low temperature and low humidity conditions, and even if the ejection failure occurs, the normal state is restored by small scale refreshing process such as preliminary ejection or suction recovery. According to the present invention, the time required for the recovery can be reduced, and the loss of the liquid by the recovery operation is reduced, so that running cost can be reduced.

In an aspect of improving the refilling property, the responsivity, the stabilized growth of the bubble and stabilization of the liquid droplet during the continuous ejections are accomplished, thus permitting high speed recording.

With the head of the two-flow-path structure, the latitude of selection of the ejection liquid is wide since the bubble generation liquid may be the one with which the bubble generation is easy and with which the deposited material (burnt deposit or the like) is easily produced. Therefore, the liquids which have not been easily ejected through the conventional bubble jet ejecting method, such as high viscosity liquid with which bubble generation is difficult or a liquid which tends to produce burned deposit on the heater, can be ejected in good order.

Furthermore, a liquid which is easy influenced by heat can be ejected without adverse influence.

According to the present invention, the liquid ejecting head can be manufactured with high precision, and can be manufactured at low cost since the number of parts is small.

When the liquid ejecting head of this invention is used as a liquid ejection recording head, high image quality recording is accomplished.

According to the present invention, there is provided a liquid ejecting apparatus or recording system wherein the ejection efficiency of the liquid or the like is further improved.

The head can be easily reused using the present invention, when the head cartridge or the like of the present invention is used.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting method for ejecting a liquid by generation of a bubble, comprising the steps of:

preparing a head having an ejection outlet for ejecting the liquid, a bubble generation region for generating the bubble in the liquid, a movable member disposed faced to said bubble generation region and displaceable between a first position and a second position further from said bubble generation region than the first position;

displacing the movable member from said first position to said second position by pressure produced by the generation of the bubble in said bubble generating portion to permit expansion of the bubble more in a downstream side closer to the ejection outlet than in an upstream side;

wherein said displacing step comprises a first bubble generation step of displacing a free end side of said movable member by pressure produced by generation of a bubble in said bubble generating region and a second bubble generation step of generating at least one other bubble in said bubble generating region, while said movable member is located at a displaced position by said first bubble generating step, to eject the liquid through the ejection outlet, wherein said first bubble generation step displaces the movable member without electing the liquid through the ejection outlet, and said second bubble generation step elects the liquid through the ejection outlet.

2. A method according to claim 1, wherein the bubble is generated by a heat generating element means, which causes a film boiling phenomenon in the liquid to generate the bubble.

3. A method according to claim 2, wherein the heat generating element means has a first heat generating element and a second heat generating element.

4. A method according to claim 3, wherein said first heat generating element and said second heat generating element are arranged in a direction toward the ejection outlet.

5. A method according to claim 3, wherein said first heat generating element and said second heat generating element are arranged in parallel in a direction toward the ejection outlet.

6. A method according to claim 3, 4 or 5, wherein said first bubble generation step is carried out by driving the first heat generating element, and said second bubble generation step is carried out by driving said second heat generating element.

7. A method according to claim 3, 4 or 5, wherein said first bubble generation step is carried out by driving said first heat generating element, and said second bubble generation step is carried out by driving said first heat generating element and the second heat generating element.

8. A method according to claim 3, 4 or 5, wherein said first bubble generation step is carried out by driving said second heat generating element, and said second bubble generation step is carried out by driving said first heat generating element.

9. A method according to claim 3, 4 or 5, wherein said first bubble generation step is carried out by driving said second heat generating element, and said second bubble generation step is carried out by driving said first heat generating element and the second heat generating element.

10. A liquid ejecting method for ejecting a liquid by generation of a bubble, comprising the steps of:

supplying the liquid along a heat generating element disposed along a flow path from upstream of the heat generating element; and applying heat generated by the heat generating element to the thus supplied liquid to generate a bubble, thus moving a free end of a movable member having the free end adjacent the ejection outlet side by pressure produced by the generation of the bubble, said movable member being disposed faced to said heat generating element, wherein said displacing step includes a first bubble generation step of displacing a free end side of said movable member by pressure produced by generation of a bubble in said bubble generating region, and a second bubble generation step of generating at least one other bubble in said bubble generating region, while said movable member is located at a displaced position by said first bubble generating step, to eject the liquid through the ejection outlet, wherein said first bubble generation step displaces the movable member without electing the liquid through the election outlet, and said second bubble generation step ejects the liquid through the ejection outlet.

11. A method according to claim 10, wherein the bubble is generated by a heat generating element means, which causes a film boiling phenomenon in the liquid to generate the bubble.

12. A method according to claim 11, wherein the heat generating element means has a first heat generating element and a second heat generating element.

13. A method according to claim 12, wherein said first heat generating element and said second heat generating element are arranged in a direction toward the ejection outlet.

14. A method according to claim 12, wherein said first heat generating element and said second heat generating element are arranged in parallel in a direction toward the ejection outlet.

15. A method according to claim 12, 13 or 14, wherein said first bubble generation step is carried out by driving the first heat generating element, and said second bubble generation step is carried out by driving said second heat generating element.

16. A method according to claim 12, 13 or 14, wherein said first bubble generation step is carried out by driving said first heat generating element, and said second bubble generation step is carried out by driving said first heat generating element and the second heat generating element.

17. A method according to claim 12, 13 or 14, wherein said first bubble generation step is carried out by driving said second heat generating element, and said second bubble generation step is carried out by driving said firs t heat generating element.

18. A method according to claim 12, 13 or 14, wherein said first bubble generation step is carried out by driving said second heat generating element, and said second bubble generation step is carried out by driving said first heat generating element and the second heat generating element.

19. A liquid ejecting method for ejecting a liquid by generation of a bubble, comprising the steps of:

preparing a head including a first liquid flow path in fluid communication with a liquid ejection outlet, a second liquid flow path having a bubble generation region and a movable member disposed between said first liquid flow path and said bubble generation region and having a free end adjacent the ejection outlet side; and generating a bubble in said bubble generation region to displace the free end of the movable member into said first liquid flow path by pressure produced by the generation of the bubble, thus guiding the pressure toward the ejection outlet of said first liquid flow path by the movement of the movable member to eject the liquid, wherein said displacing step includes a first bubble generation step of displacing a free end side of said movable member by pressure produced by generation of a bubble in said bubble generating region, and a second bubble generation step of generating at least one other bubble in said bubble generating region, while said movable member is located at a displaced position by said first bubble generating step, to eject the liquid through the ejection outlet, wherein said first bubble generation step displaces the movable member without electing the liquid through the election outlet, and said second bubble generation step elects the liquid through the election outlet.

20. A method according to claim 19, wherein the bubble is generated by a heat generating element means, which causes a film boiling phenomenon in the liquid to generate the bubble.

21. A method according to claim 20, wherein the heat generating element means has a first heat generating element and a second heat generating element.

22. A method according to claim 21, wherein said first heat generating element and said second heat generating element are arranged in a direction toward the ejection outlet.

23. A method according to claim 21, wherein said first heat generating element and said second heat generating element are arranged in parallel in a direction toward the ejection outlet.

24. A method according to claim 21, 22 or 23, wherein said first bubble generation step is carried out by driving the first heat generating element, and said second bubble generation step is carried out by driving said second heat generating element.

25. A method according to claim 21, wherein said first bubble generation step is carried out by driving said first heat generating element, and said second bubble generation step is carried out by driving said first heat generating element and the second heat generating element.

26. A method according to claim 21, 22 or 23, wherein said first bubble generation step is carried out by driving said second heat generating element, and said second bubble generation step is carried out by driving said first heat generating element.

27. A method according to claim 21, 22 or 23, wherein said first bubble generation step is carried out by driving said second heat generating element, and said second bubble generation step is carried out by driving said first heat generating element and the second heat generating element.

28. A method according to any one of claims 19–23 or 25, wherein the liquid supplied to said first liquid flow path and the liquid supplied to said second liquid flow path are the same.

29. A method according to any one of claims 19 to 23, wherein the liquid supplied to said first liquid flow path and the liquid supplied to said second liquid flow path are different.

30. A method according to any one of claims 19 to 23, wherein the liquid supplied to the second liquid flow path has at least one of lower viscosity, higher bubble forming property and higher thermal stability than the liquid supplied to the first liquid flow path.

31. A liquid ejecting head comprising:

an ejection outlet for ejecting a liquid;

a bubble generation region for generating a bubble in the liquid:

a movable member disposed faced to said bubble generation region and displaceable between a first position and a second position further from said bubble generation region than the first position, wherein said movable member moves from the first position to the second position by pressure produced by the generation of the bubble to permit expansion of the bubble more in a downstream side closer to the ejection outlet than in an upstream side;

first bubble generation means for displacing a free end side of said movable member by pressure produced by generation of a bubble in said bubble generating region; and second bubble generation means for generating at least one other bubble in said bubble generating region, while said movable member is located at a displaced position by said first bubble generating, to eject the liquid through the ejection outlet, wherein said first bubble generation means displaces the movable member without ejecting the liquid through the ejection outlet, and said second bubble generation means ejects the liquid through the ejection outlet.

32. A head according to claim 31, wherein the bubble is generated by a heat generating element means, which causes a film boiling phenomenon in the liquid to generate the bubble.

33. A head according to claim 32, wherein the heat generating element means has a first heat generating element and a second heat generating element.

34. A head according to claim 33, wherein said first heat generating element and said second heat generating element are arranged in a direction toward the ejection outlet.

35. A head according to claim 33, wherein said first heat generating element and said second heat generating element are arranged in parallel in a direction toward the ejection outlet.

36. A head according to any one of claims 33 to 35, wherein said first bubble generation means drives a first heat generating element, and said second bubble generation means drives a second heat generating element.

37. A head according to any one of claims 33 to 35, wherein said first bubble generation means drives a first heat generating element, and said second bubble generation means drives the first heat generating element and the second heat generating element.

38. A head according to any one of claims 33 to 35, wherein said first bubble generation means drives a second heat generating element, and said second bubble generation means drives a first heat generating element.

39. A head according to any one of claims 33 to 35, wherein said first bubble generation means drives a second heat generating element, and said second bubble generation means drives a first heat generating element and the second heat generating element.

40. A head according to claim 31, wherein said liquid ejection head includes a first path in fluid communication with said ejection outlet and a second path having the bubble generating region.

41. A liquid ejecting head comprising:

an ejection outlet for ejecting a liquid;

a bubble generation region for generating a bubble in the liquid: and a movable member disposed faced to said bubble generation region and having a downstream free end, wherein said movable member is displaced by a first bubble generated in said bubble generation region, and at least one other bubble is generated while said movable member is still in a displaced position to eject the liquid, wherein said first bubble displaces the movable member, and the liquid is ejected through the ejection outlet by the generation of said at least one other bubble.

42. A head according to claim 41, further comprising a heat generating element, in said bubble generation region, for generating the bubble.

43. A head according to claim 31 or 41, wherein said liquid is an ink.

44. A liquid ejecting apparatus for ejecting a liquid, comprising:

a liquid ejection head including an ejection outlet for ejecting the liquid; a bubble generating means for generating a bubble in the liquid: and a movable member disposed faced to said bubble generation means and having a downstream free end;

wherein said movable member is displaced by a first bubble generated by said bubble generating means, and at least one other bubble is generated while said movable member is still in a displaced position to eject the liquid, wherein said first bubble displaces the movable member, and the liquid is elected through the election outlet by the generation of said at least one other bubble.

45. An apparatus according to claim 44, wherein said bubble generating means has a first heat generating element and a second heat generating element, and the bubble is generated by a heat generating element means, which causes the film boiling phenomenon in the liquid to generate the bubble.

46. An apparatus according to claim 45, wherein said first bubble generation step is carried out by driving the first heat generating element, and the other bubble is generated by driving said second heat generating element.

47. An apparatus according to claim 45, wherein said first bubble generation step is carried out by driving said first heat generating element, and the other bubble is generated by driving said first heat generating element and the second heat generating element.

48. An apparatus according to claim 44, further comprising recording material feeding means for feeding a recording material which receives the liquid ejected from said liquid ejection head.

49. An apparatus according to claim 44, wherein said liquid is an ink, which is ejected from said ejection outlet to effect recording on a recording material.

50. An apparatus according to claim 44, wherein said liquid is a recording liquid, which is ejected from said ejection outlet to effect recording on a textile.

51. An apparatus according to claim 44, wherein a plurality of liquids of different colors are ejected to effect color recording.

52. An apparatus according to claim 44, wherein a plurality of said ejection outlets are disposed over a width of a recordable region of the recording material.

* * * * *

UNITED STATES PATENT AND TRADEMARK OFFICE

CERTIFICATE OF CORRECTION

PATENT NO. : 6,154,237
DATED : November 28, 2000
INVENTOR(S) : Toshio Kashino et al.

It is certified that error appears in the above-identified patent and that said Letters Patent is hereby corrected as shown below:

Column 1,
Line 28, "Figure" should read -- figure --;
Line 36, "resulted" should read -- resulting --;
Line 44, "With such" should read -- Such --;
Line 45, "image," should read -- image --; and
Line 51, "another" should read -- other --.

Figure 1A:
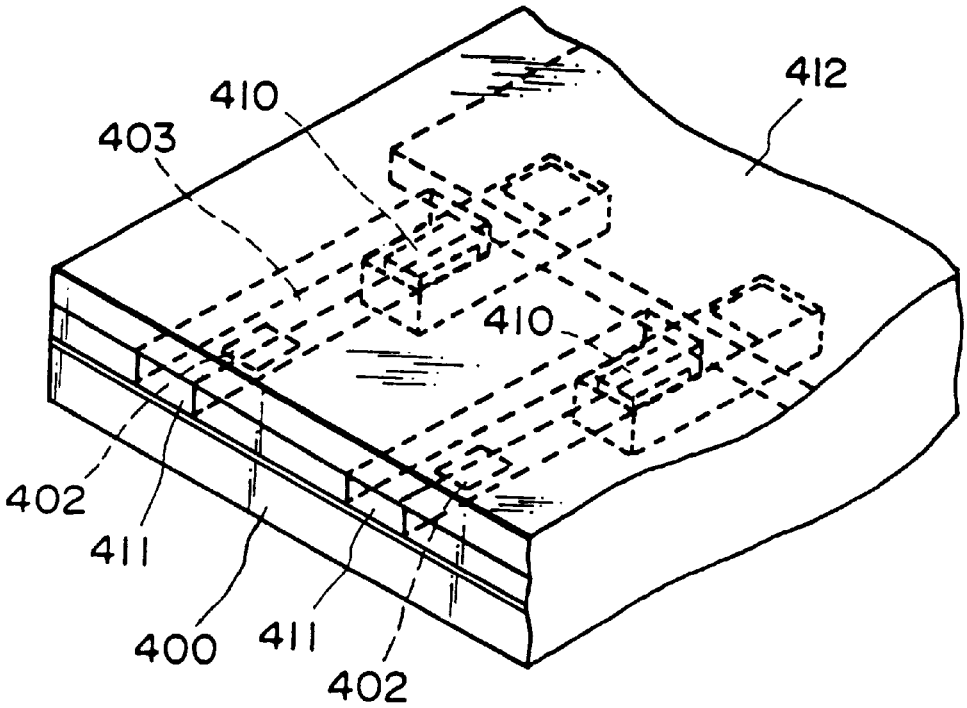
FIGS. 1 (*a*) and 1 (*b*) illustrate a liquid flow passage structure of a conventional liquid ejecting head.
Figure 1B:
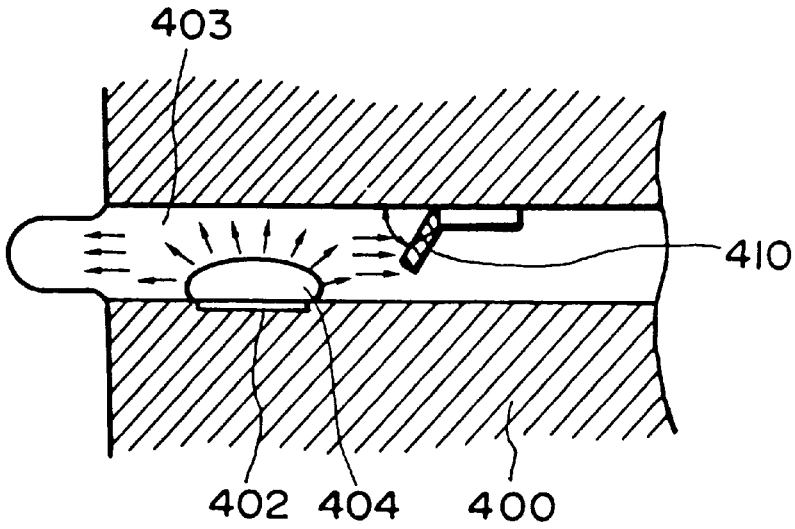

Column 2,
Line 7, "FIG. 1,(a) and (b)," should read -- FIGS. 1(a) and 1(b), --;
Line 13, "disclosures"should read -- discloses --;
Line 50, "some" should read -- same --; and
Line 58, "directly" should read -- directed --.

Column 3,
Lines 31 and 49, "including:" should read -- includes: --.

Column 4,
Line 3, "including:" should read -- includes: --; and
Line 67, "function" should read -- functions --.

Column 5,
Line 34, "FIG. 6 is" should read -- FIGS. 6(a) through 6(d) are --;
Line 36, "(a), (b), (c) and (d)" should read -- (a) through (d) --;
Line 54, "is a" should be deleted;
Line 55, "ember" should read -- member --; and
Line 61, "section" should read -- sectional --.

Column 6,
Line 34, "EMBODIMENT" should read -- EMBODIMENTS --.

Column 7,
Line 55, "not any" should read -- no --; and
Line 59, "of the" should be deleted.

Figure 6A:
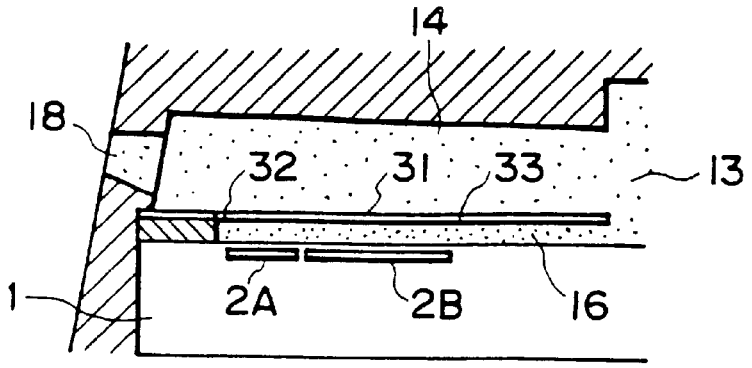
FIG. 6 is schematic sectional views illustrating a liquid ejecting method using a liquid ejecting head in an embodiment of the present invention, wherein (a), (b), (c) and (d) show various steps.

Column 8,
Line 34, "FIG. 6, (a)" should read -- FIG. 6(a) --;
Line 46, "FIG. 6,(b)" should read -- FIG. 6(b) --;
Line 58, "the-downstream" should read -- the downstream --; and
Line 65, FIG. 6, (c)" should read -- FIB. 6(c) --.

UNITED STATES PATENT AND TRADEMARK OFFICE

CERTIFICATE OF CORRECTION

PATENT NO. : 6,154,237
DATED : November 28, 2000
INVENTOR(S) : Toshio Kashino et al.

Figure 6B:
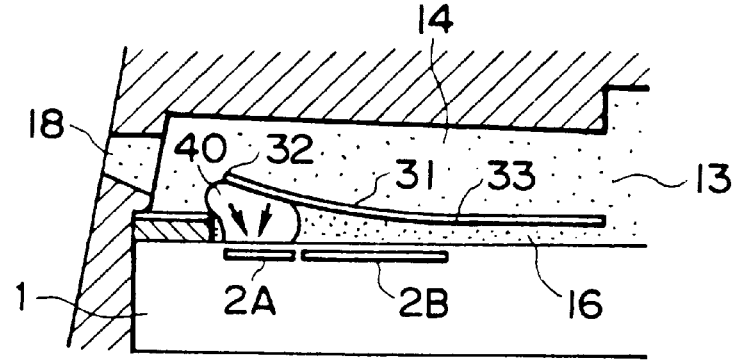
Figure 6C:
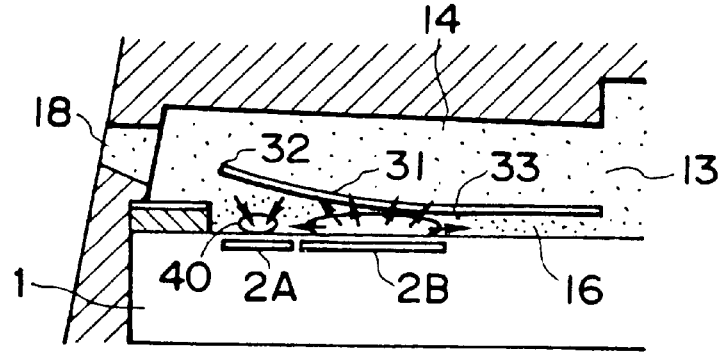
Figure 6D:
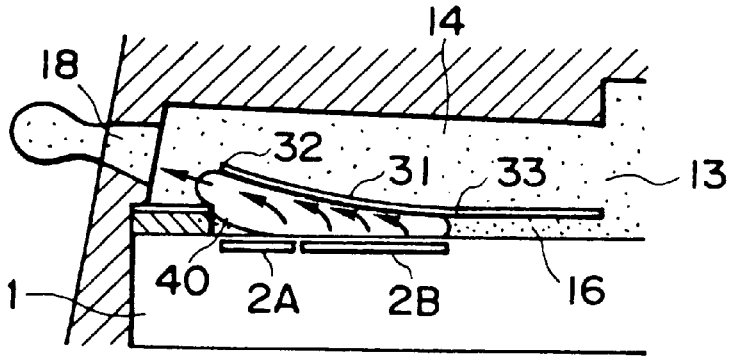
Figure 7:
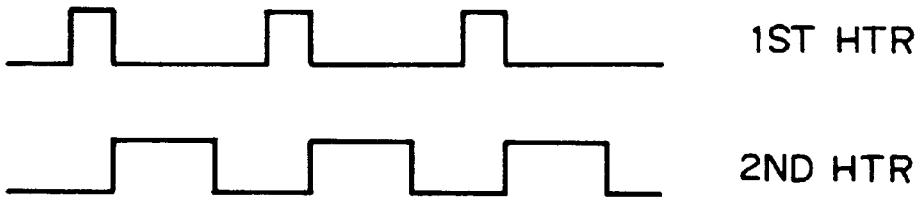
FIG. 7 is a timing chart showing an example of driving of first heat generating element and second heat generating element used in an embodiment of the present invention.

It is certified that error appears in the above-identified patent and that said Letters Patent is hereby corrected as shown below:

Column 9,
Line 4, "In embodiment," should read -- In this embodiment, --; and
Line 13, "FIG. 6, (d)" should read -- FIG. 6(d) --.

Column 11,
Line 36, "that" should read -- that the --.

Column 12,
Line 35, "FIG. 6(b) and (d), should read -- FIGS. 6(b) and 6(d), --.

Figure 12A:
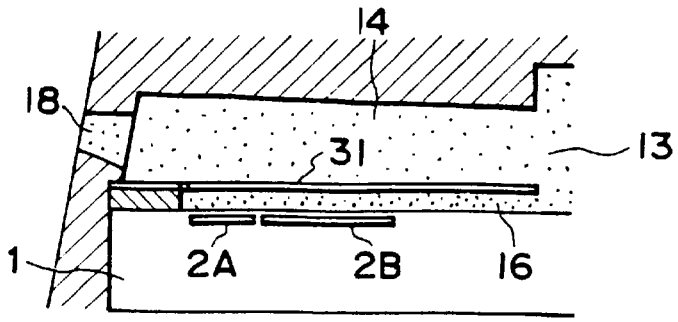
FIGS. 12 (*a*) through 12 (*e*) are is a schematic sectional views illustrating a manufacturing method of a movable ember of a liquid ejecting head in an embodiment of the present invention, wherein (a) through (e) show various steps.
Figure 12B:
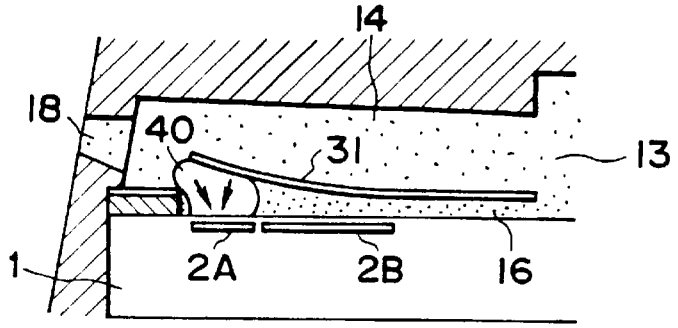
Figure 12C:
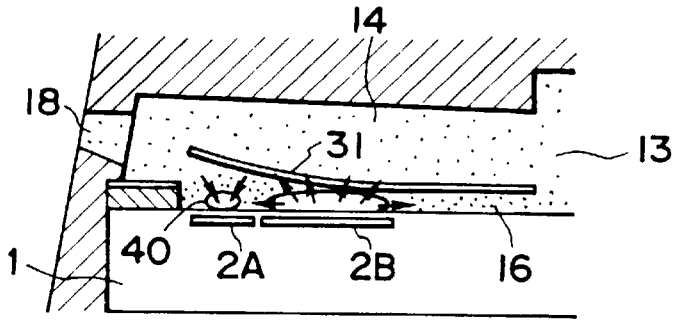
Figure 12D:
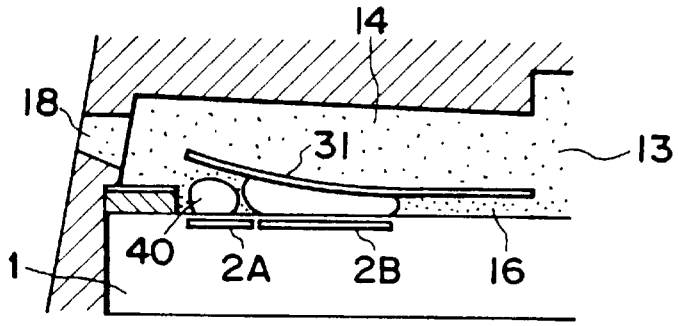
Figure 12E:
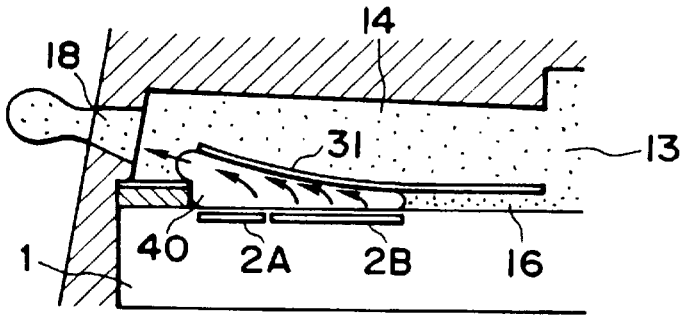
Figure 13:
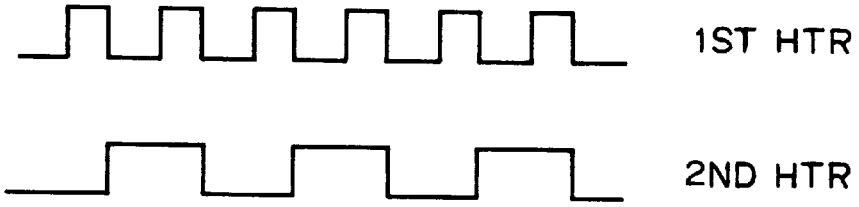
FIG. 13 is a timing chart illustrating an example of driving of a first heat generating element and a second heat generating element in an embodiment of the present invention.
Figure 14:
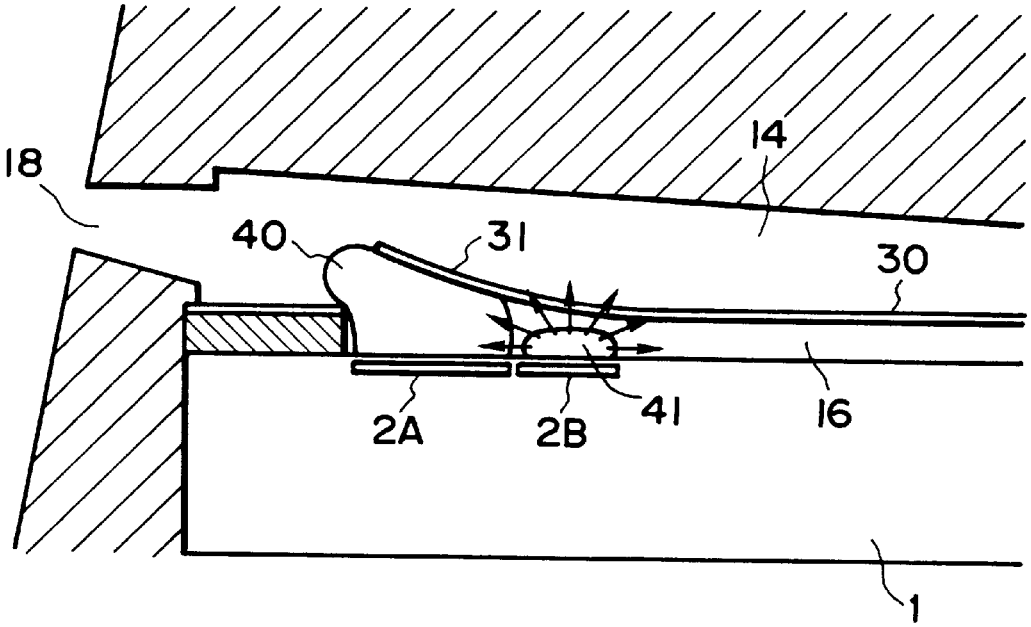
FIG. 14 is a section schematic view taken along a direction of flow of the liquid in a liquid ejecting head in an embodiment of the present invention.

Column 13,
Line 45, "FIG. 12, (a)" should read -- FIG. 12(a) --; and
Line 56, "FIG. 12, (b)" should read -- FIG. 12(b) --.

Column 14,
Line 9, "FIG. 12, (c)" should read -- FIG. 12 (c) --;
Line 15, "In embodiment," should read -- In this embodiment, --;
Line 24, "FIG. 12, (d)," should read -- FIG. 12(d), --;
Line 28, "growths" should read -- grows --; and
Line 54, "2A. Is" should read -- 2A is --.

Column 15,
Line 16, "time-of" should read -- time of --;
Line 20, "bubble," should read -- the bubble, --;
Line 34, "anyone" should read -- any --; and
Line 65, "member, is" should read -- member are --.

Column 18,
Lines 10 and 11, "member 6" should read -- member 31 --;
Line 12, "FIG. 17, (a)" should read -- FIG. 17(a) --;
Line 13, "FIG. 19, (b)" should read -- FIG. 19(b) --;
Line 23, "FIG. 19, (a)," should read -- FIG. 19(a), --; and
Line 47, "liquid" should read -- liquid is --.

Figure 20C:
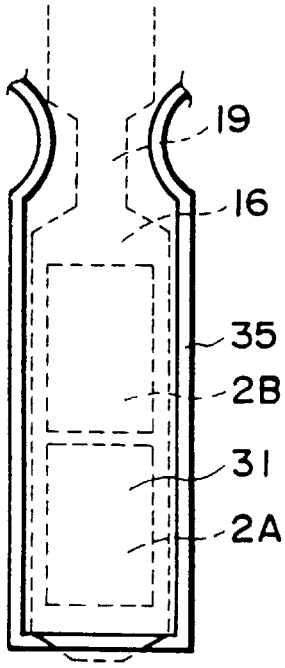

Column 19,
Line 18, "FIG. 15, (c)" should read -- FIG. 15(c) --; and
Line 59, "FIG. 20, (c)," should read -- FIG. 20(c), --.

UNITED STATES PATENT AND TRADEMARK OFFICE

CERTIFICATE OF CORRECTION

PATENT NO. : 6,154,237
DATED : November 28, 2000
INVENTOR(S) : Toshio Kashino et al.

It is certified that error appears in the above-identified patent and that said Letters Patent is hereby corrected as shown below:

Column 20,
Line 4, "FIG. 23, (b)" should read -- FIG. 23(b) --; and
Line 27, "FIG. 20, (a)," should read -- FIG. 20(a), --.

Column 21,
Line 57, "liquid" should read -- liquids --; and
Line 65, "FIG. 22," should read -- FIG. 22 --.

Column 22,
Line 43, "reduces" should read -- reduced --.

Column 23,
Line 17, "the grooved" should read -- the grooved member 50 --.

Column 24,
Line 50, "includes:" should read -- include: --.

Column 25,
Line 4, "of" should be deleted.

Column 27,
Line 34, "motor 11 1" should read -- motor 111 --.

Column 28,
Line 42, "correspondent" should read -- corresponding --;
Line 54, "medium" should read -- mediums --; and
Line 66, "postprinting" should read -- post-printing --.

Column 29,
Line 56, "easy" should read -- easily --.

Column 30,
Line 17, "tion;" should read -- tion; and --;
Line 23, "side;" should read -- side, --;
Line 32, "outlet," should read -- outlet, and --;
Line 34, "electing" should read -- ejecting --; and
Line 36, "elects" should read -- ejects --.

UNITED STATES PATENT AND TRADEMARK OFFICE

CERTIFICATE OF CORRECTION

PATENT NO. : 6,154,237
DATED : November 28, 2000
INVENTOR(S) : Toshio Kashino et al.

It is certified that error appears in the above-identified patent and that said Letters Patent is hereby corrected as shown below:

Column 31,
Line 23, "outlet," should read -- outlet, and --;
Line 25, "electing" should read -- ejecting --;
Line 26, "election" should read -- ejection --; and
Line 56, "firs t" should read -- first --.

Column 32,
Line 20, "outlet," should read -- outlet, and --;
Line 22, "electing" should read -- ejecting --;
Line 23, "election" should read -- ejection --; and
Line 24, "elects" should read -- ejects -- and "election" should read -- ejection --.

Column 33,
Line 8, "liquid:" should read -- liquid; --;
Line 12, "wherein" should read -- ¶ wherein --; and
Line 25, "generating," should read -- generation means, --.

Column 34,
Line 4, "liquid:" should read -- liquid; --;
Line 11, "liquid," should read -- liquid, and --;
Line 22, "liquid; a" should read -- liquid; ¶ a --;
Line 23, "liquid: and" should read -- liquid; ¶ and --;
Line 25, "end;" should read -- end, --;
Line 31, "liquid," should read -- liquid, and --; and
Line 33, "elected" should read -- ejected -- and "election" should read -- ejection --.

Signed and Sealed this

Twenty-fifth Day of December, 2001

*Attest:*

*Attesting Officer*

JAMES E. ROGAN
*Director of the United States Patent and Trademark Office*